US006080535A

United States Patent [19]

Kondo

[11] Patent Number: 6,080,535

[45] Date of Patent: Jun. 27, 2000

[54] SILVER HALIDE PHOTOGRAPHIC EMULSION AND SILVER HALIDE LIGHT SENSITIVE PHOTOGRAPHIC MATERIAL BY THE USE THEREOF

[75] Inventor: Toshiya Kondo, Hino, Japan

[73] Assignee: Konica Corporation, Japan

[21] Appl. No.: 09/153,539

[22] Filed: Sep. 16, 1998

[30] Foreign Application Priority Data

Sep. 18, 1997 [JP] Japan ..... 9-253558

[51] Int. Cl.[7] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 5,087,555 | 2/1992 | Saitou | 430/567 |
| 5,460,936 | 10/1995 | Kondo et al. | 430/567 |
| 5,482,826 | 1/1996 | Okamura et al. | 430/569 |
| 5,492,801 | 2/1996 | Maskasky | 430/567 |
| 5,525,460 | 6/1996 | Maruyama et al. | 430/567 |
| 5,527,664 | 6/1996 | Kikuchi et al. | 430/569 |
| 5,550,015 | 8/1996 | Karthauser | 430/569 |
| 5,567,580 | 10/1996 | Fenton et al. | 430/567 |
| 5,578,438 | 11/1996 | Takada | 430/567 |

OTHER PUBLICATIONS

European Search Report EP 98 30 7544.

*Primary Examiner*—Mark F. Huff

*Attorney, Agent, or Firm*—Jordan B. Bierman; Bierman, Muserlian and Lucas

[57] ABSTRACT

A silver halide emulsion is disclosed, comprising a dispersing medium and silver halide grains, wherein at least 50% by number of the silver halide grains is accounted for by tabular silver halide grains containing silver iodide, the tabular grains each meeting the following requirement:

$$I_1 > I_2$$

wherein $I_1$ is a silver iodide content of an outermost layer in the major face region and $I_2$ is a silver iodide content of an outermost layer in the side-face region.

10 Claims, No Drawings

SILVER HALIDE PHOTOGRAPHIC EMULSION AND SILVER HALIDE LIGHT SENSITIVE PHOTOGRAPHIC MATERIAL BY THE USE THEREOF

FIELD OF THE INVENTION

The present invention relates to a silver halide photographic emulsion and specifically, to a silver halide emulsion having enhanced sensitivity without increasing fog and a silver halide light sensitive photographic material by the use of the same.

BACKGROUND OF THE INVENTION

Recently, along with the increased popularity of picture-taking instruments such as cameras, there increase picture-taking chances by use of a silver halide light sensitive photographic material (hereinafter, also referred to as a photographic material). As a result, further enhancement in sensitivity and image quality has been desired by the public.

One dominant factor for enhancing sensitivity and image quality of the photographic material concerns silver halide grains, and there has been on going development of silver halide grains aimed at enhancement of sensitivity and image quality. As is well recognized in the art, however, in conjunction with decreasing the silver halide grain size for enhancing image quality, the sensitivity tends to be lowered, and enhancing both sensitivity and image quality has its limits.

To further enhance the sensitivity and the image quality have been studied techniques for enhancing the ratio of sensitivity to grain size of the grain. One technique is to employ tabular silver halide grains, as described in JP-A 58-111935, 58-111936, 58-111937, 58-113927 and 59-99433 (herein, the term, JP-A means a unexamined, published Japanese Patent Application). When compared to a silver halide regular crystal grain such as octahedral, tetradecahedral or hexahedral grain, the surface area of a tabular silver halide grain is larger than that of the regular grain having the same volume, allowing more sensitizing dyes to be adsorbed onto the silver halide grain surface and advantageously leading to further enhancement of sensitivity. JP-A 6-230491, 6-235988, 6-258745 and 6-289516 disclose the use of tabular silver halide grains having still higher aspect ratios (i.e., a ratio of grain diameter to thickness).

JP-A 63-92942 discloses a technique of providing a core having a high silver iodide content in the interior of tabular silver halide grains and JP-A 63-163541 discloses a technique of employing tabular silver grains having a ratio of grain thickness to a longest spacing between twin planes of 5 or more, each leading to improvements in sensitivity and image quality.

JP-A 63-106746 discloses tabular silver halide grains having a substantially layered structure in the direction parallel to the two opposing major faces. JP-A 1-279237 discloses tabular silver halide grains having a layer structure bounded by a plane substantially parallel to the two opposing major faces and further having an outermost layer having an average silver iodide content higher by 1 mol % or more than the average overall silver iodide content.

JP-A 3-12445 discloses silver halide grains having parallel twin planes and interfacial layers containing regions which are different in the silver iodide content; JP-A 63-305343 discloses tabular silver halide grains having development initiating points in the vicinity of the grain corner; and JP-A 2-34 discloses silver halide grains having (100) and (111) faces.

JP-A 1-183644 discloses a technique of employing tabular silver halide grains characterized in that the silver iodide content distribution of iodide containing silver halide grains is completely uniform.

There is also disclosed a technique of controlling carriers through metal doping, i.e., a technique of improving photographic performance by allowing a polyvalent metal oxide to be contained within the grain.

JP-A 3-196135 and 3-189641 disclose a silver halide emulsion which was prepared in the presence of an oxidizing agent with respect to silver and effects on sensitivity and fog of a photographic material by use of the emulsion. Further, JP-A 63-220238 discloses a technique of a silver halide emulsion containing tabular grains in which the position of dislocation lines is limited; JP-3-175440 discloses a technique of employing a silver halide emulsion containing tabular grains in which dislocation lines are concentrated in the vicinity of the grain corners; JP-B 3-18695 (herein, the term, JP-B means published Japanese Patent) discloses a technique of silver halide grains having a distinctive core/shell structure; and JP-B 3-31245 discloses silver halide grains having a core/shell type three-layered structure.

JP-A 6-11781, 6-11782, 6-27564, 6-250309, 6-250310, 6-250311, 6-250313 and 6-242527 each disclose techniques for achieving enhanced sensitivity and improved fog and pressure resistance by the use of an iodide ion-releasing compound during grain formation.

However, the prior art described above is limited in achieving enhancement of both sensitivity and image quality and insufficient for satisfying requirements in recent photographic materials, therefore, development of a technique superior to the prior art is desired.

To subject silver halide grains more effectively to chemical sensitization and spectral sensitization, development of a technique to enable more accurate control of sensitivity specks and halide composition on the silver halide grain surface is needed, and studies which have been made so far in the art were insufficient to meet this need.

SUMMARY OF THE INVENTION

Accordingly, an object of the present invention is to provide a silver halide photographic emulsion achieving enhanced sensitivity/fog level which has never been accomplished by the prior art and a silver halide light sensitive photographic material by use of the same.

The above object of the present invention can be accomplished by the following means.

(1) A silver halide emulsion comprising a dispersing medium and silver halide grains, wherein at least 50% by number of the silver halide grains is accounted for by tabular silver halide grains containing silver iodide and meeting the requirement, $I_1>I_2$, wherein $I_1$ (mol %) is an average silver iodide content of an outermost layer in the major face region of the grain and $I_2$ (mol %) is an average silver iodide content of an outermost layer in the side-face region of the grain;

(2) the silver halide emulsion described in (1), wherein $I_2/I_1<0.77$ and $I_1$ is less than 30 mol %;

(3) the silver halide emulsion described in (1), wherein $I_2/I_1<0.4$;

(4) the silver halide emulsion described in any one of (1) to (3) being monodispersed;

(5) the silver halide emulsion described in any one of (1) to (4) being prepared by using a compound represented by the following formula (I):

$$A\text{-}\{\text{-}(L)m\text{-}(Z)n\}r \qquad \text{formula (I)}$$

wherein A represents an adsorption group onto silver halide, L represents a divalent or trivalent linkage group, Z represents a substituent capable of releasing a halide ion, m is 0 or 1, n is 1 or 2, and r is 1, 2 or 3;

(6) a method of preparing a silver halide emulsion, wherein after forming silver halide substrate grains, an iodide ion releasing agent capable of being adsorbed on a (111) face is used;

(7) a method of preparing a silver halide emulsion, wherein an iodide ion releasing agent capable of being adsorbed on a (111) face is used in silver halide having (111) side-faces; and (8) a silver halide light sensitive photographic material having a silver halide emulsion layer comprising the silver halide emulsion described in any one of (1) to (5).

DETAILED DESCRIPTION OF THE INVENTION

The present invention will be further described in detail.

Silver halide grains used in the invention are comprised of tabular rains having two twin planes parallel to the major faces, the percentage of which is 50% by number or more, preferably 60% or more, more preferably 70% or more, and still more preferably 80% or more.

The tabular grains according to the invention refers to silver halide grains having an aspect ratio of 1.3 or more. The aspect ratio is preferably 3.0 to 100, and more preferably 5.0 to 50. The aspect ratio is referred to a ratio of grain diameter to grain thickness.

To determine the aspect ratio, the diameter and the thickness of silver halide grains can be measured according to the following manner. Thus, a sample is prepared by coating on a support latex balls with a known diameter as a internal standard and silver halide grains so that the major faces are oriented in parallel to the support. After being subjected to shadowing from a given direction by the carbon vapor deposition method, a replica sample is prepared by a conventional replica method. From electronmicrographs of the sample, the projected area diameter and thickness can be determined using an image processing apparatus. In this case, the silver halide grain thickness can be determined from the internal standard and the length of shadow of the grain.

The twin plane of silver halide grains can be observed with a transmission electron microscope, for example, according to the following manner. A coating sample is prepared by coating a silver halide emulsion on a support so that the major faces of tabular silver halide grains are oriented substantially in parallel to the support. The sample is sliced by a diamond cutter to obtain an approximately. 0.1 μm thick slice. The presence of the twin plane can then be observed with a transmission electron microscope.

Furthermore, the tabular silver halide grains preferably account for at least 50%, more preferably at least 60%, and still more preferably at least 80% of the total projected area of silver halide grains contained in the emulsion.

The average diameter of the tabular silver halide grains according to the invention is preferably 0.2 to 20 μm, more preferably 0.3 to 15 μm, and still more preferably 0.5 to 5.0 μm. The average diameter is an arithmetic average of diameters (ri), provided that the significant figure is three figures, the last digit is rounded off and at least 1,000 randomly selected grains, are subjected to measurement.

In the case of tabular silver halide grains, the grain diameter is the diameter of a circle having an area equivalent to the projected area when viewed from the direction perpendicular to the major faces; and in the case of silver halide grains other than the tabular grains, the grain diameter is the diameter of a circle equivalent to the grain projected area. The grain diameter (ri) can be determined viewing silver halide grains at a factor of 10,000 to 70,000 times with an electron microscope and measuring the diameter or projected area.

The silver halide emulsion according to the invention may be optionally employed, such as a polydispersed emulsion with a wide diameter distribution and a monodispersed emulsion with a narrower diameter distribution, however, the monodispersed emulsion is preferred. The monodispersed emulsion has preferably less than 20%, and more preferably less than 16% of the grain diameter distribution (or a variation coefficient of grain diameter), as defined below:

Grain size distribution (%)=(standard deviation of grain diameter/average grain diameter)×100 where the average diameter and the standard deviation are determined from the diameter (ri) defined above.

The silver halide emulsion according to the invention may be any one of conventionally used silver halide, such as silver iodobromide, silver iodochlorobromide or silver iodochloride, and silver iodobromide or silver iodochlorobromide is preferred. The average silver iodide content of silver halide grains contained in the emulsion is preferably 0.5 to 30 mol %, and more preferably 1 to 20 mol %.

The average silver iodide content of a silver halide grain group can be determined by the EPMA method (or Electron Probe Micro Analyzer method). Thus, a sample which is prepared by dispersing silver halide grains so that the grains are not in contact with each other, is exposed to electron beams while cooled with liquid nitrogen to not higher than −100° C. Characteristic X-ray intensities of silver and iodine which are radiated from individual grains are measured to determine the silver iodide content of each grain. At least 50 grains are subjected to measurement and their average value is determined.

Silver halide grains contained in the silver halide emulsion according to the invention are preferably core/shell type grains. The core/shell type grains are those comprised of a core and a shell covering the core. The shell is formed of one or more layers. Silver iodide contents of the core and the shell preferably differ from each other.

The outermost layer of the silver halide grain is a silver halide phase within a region from the surface to a depth of 50 Å from the grain surface. The silver iodide content of the outermost layer is an average value of silver iodide contents measured at five or more sites at uniform intervals. In the case of the major face region, the interval is at least 1/10 of the grain diameter. In the side-face region, the interval is at least 1/10 of the grain thickness.

The average silver iodide content of the outermost layer in the major face region or the side-face region can be measured in the following manner. Thus, tabular silver halide grains which are taken out of the emulsion through gelatin degradation by proteinase, are embedded in a methacrylate resin and then, continuously cut into ca. 500 Å thick slices by using a diamond cutter. Specifically, in reference to a slice showing a cross-section vertical to two parallel major faces, a silver halide phase within a region of from the surface parallel to the major faces to a depth of 50 Å from the surface, refers to the major face region; and the outermost layer other than the major face region refers to the side-face region. With respect to the major face region and the side-face region, the silver iodide content can be determined by the dot analysis using the EPMA method with a spot diameter of 50 Å or less, and preferably 20 Å or less.

The silver halide emulsion is characterized in that when the average iodide content of the outermost layer in the major face region is $I_1$ mol % and that in the side-face region is $I_2$ mol %, at least 50% by number of the total emulsion grains is accounted for by tabular grains meeting the requirement of $_1>I_2$. The relationship between $I_1$ and $I_2$ is preferably $I_2/I_1<0.77$, more preferably $I_2/I_1<0.5$, and still more preferably $I_2/I_1<0.4$. $I_1$ is preferably more than 0 mol %, more preferably more than 0 mol % and less than 30 mol %, and still more preferably not less than 8 mol % and not more than 20 mol %. $I_2$ is preferably not less than 0 mol %, and more preferably not more than 0 mol % and less than 7 mol %. Furthermore, in the invention, the relationship between $I_2$ and $I_3$ is preferably $I_3>I_2$, in which $I_3$ (mol %) is an average iodide content of a adjacent layer to the outermost layer in the side-face region, to a depth 100 Å (i.e., the region at a depth of 50 to 150 Å from the surface of the side-face region). $I_3$ can be determined in a manner similar to $I_1$ and $I_2$, as described above. $I_3$ is specifically not limited, but preferably not less than 1 mol % and not more than 20 mol %, and more preferably not less than 8 mol % and not more than 15 mol %.

The silver halide grains of the silver halide emulsion according to the invention preferably contain dislocation lines in the interior of the grain. The position of the dislocation lines is not limited, but the dislocation lines are present preferably in the vicinity of fringe portions, edges or corners of the grain. The dislocation lines are introduced into the silver halide grains preferably at not less than 50%, and more preferably not less than 60% and less than 85% of the total silver amount of silver halide grains. With respect to the number of dislocation lines, silver halide grains having 5 or more dislocation lines preferably account for at least 30%, more preferably at least 50%, and still more preferably at least 80%. The number of dislocation lines per grain is preferably not less than 10, more preferably not less than 20, and still more preferably not less than 30.

The dislocation lines of silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that may cause dislocation in the grains, and they are than placed on a mesh for electron microscopy. The sample is observed by transmission electron microscopy, while being cooled to prevent the grain from being damaged by electron beam (e.g., printing-out). Since electron beam penetration is hampered as the grain thickness increases, sharper observations are obtained when using a high voltage type electron microscope. From the thus-obtained electron micrograph can be determined the position and number of the dislocation lines in each grain.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution is added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed.

In one embodiment of preparing the silver halide emulsion of the invention, initially, tabular silver halide grains are prepared as a substrate, then a low iodide silver halide phase is allowed to grow preferentially in the side-face direction and thereafter, a high iodide silver halide phase is allowed to grow in the major face direction (i.e. in the direction vertical to the major face). Alternatively, a high iodide silver halide phase is allowed to grow preferentially in the major face direction and thereafter a low iodide silver halide phase is allowed to grow in the side-face direction. Further, employing methods or conditions described below, a thin silver halide layer can be minutely controlled with respect to its composition.

To allow the tabular silver halide grains to preferentially grow in the side-face direction or in the major face direction, selection of the concentration of a solution containing silver ions, halide ions or fine silver halide grains which are dissolved into silver and halide ions, growth temperature, pBr, pH and gelatin concentration are significant. Optimally, combining the parameters described above, or combining the form, halide composition and the ratio of (100) face to (111) face of the side-face, growth of the tabular substrate grain can be controlled to some extents.

For example, to allow the preferential growth in the side-face direction, the preferred pBr is 1.0 to 2.5 and the preferred gelatin concentration is 0.5 to 2.0%. To form tabular silver halide grains having a high aspect ratio and substantially no (100) side-face, the preferred pH is 2.0 to 5.0. On the other hand, the preferred pBr for preferential growth in the major face direction is 2.5 to 4.5.

For fine and uniform control of the thickness and halide composition of the outermost silver halide layer, a fine silver halide grain supplying method, which supplies silver and halide ions through dissolution, is suitable over a method of directly supplying silver and halide ions. The fine silver halide grains can be prepared according to the method described later. The fine silver halide grains are preferably subjected to desalting by using a coagulant or membrane separation method to remove unnecessary salts or ions, and more preferably to desalting by membrane separation without using a coagulant to remove unwanted salts or ions.

When forming different halide composition silver halide phases separately in the side-face direction and in the major face direction, a wash-desalting operation or a removal operation of unnecessary salts or ions by membrane separation is optimally employed. After one silver halide phase is formed, residual, excess or unnecessary halide salts are removed, preventing occurrence of unintended conversion in the subsequent preparation process, which makes it easier to control the halide composition in forming another silver halide phase. The wash-desalting operation or removing operation of unnecessary salts or ions by membrane separation is conducted preferably after forming the substrate grains and after completing growth in any one of the side-face direction and the major face direction, or after forming any halide composition silver halide phase, and more preferably after completing each of these silver halide phase formations.

As to the wash-desalting or removal of unnecessary salts or ions by membrane separation, the method described later may be applicable, and it is preferred to apply the removing operation of unnecessary salts or ions by the membrane separation method without using a coagulant.

In preparation of the silver halide emulsion according to the invention, in addition to control of grain growth conditions described above, a compound, so-called a silver halide growth controlling agent, crystal habit controlling agent or restraining agent is preferably employed to retard growth in the major face direction or side-face direction. In an exemplary embodiment of the invention, tabular silver halide grains are allowed to grow in the side-face direction to form a low iodide containing surface phase; then a polyalkyleneoxide or its related compound described in U.S. Pat. Nos. 5,147,771, 5,147,772 and 5,147,773, and JP-A 6-308644, which was employed in nucleation for the purpose of enhancing size homogeneity of tabular grains, is added to inhibit further growth in the side-face direction; and subsequently, growing a high iodide surface phase in the major face direction is facilitated to promote formation of tabular silver halide grain related to the invention.

A conversion method which adds an iodide salt or another halide salt or an epitaxial deposition method, described in JP-A 58-108526, 59-133540 and 59-162540 can also be employed to form silver halide phases differing in halide composition between the side-face and major face directions.

In separately forming silver halide phases different in halide composition between the side-face and major face directions, it is preferred to employ differences in the crystal faces between the major face and side-face, and to allow adsorptive compound such as a face-selectively adsorptive dye or inhibitor onto a specific crystal face of the silver halide grains and to form a silver halide phase with any halide composition on a non-adsorbed face.

The operation of separately forming silver halide phases differing in the side-face direction and in the major face direction may be conducted at any step in the process of from silver halide nucleation, thorough grain growth, physical ripening, desalting, spectral sensitization and chemical sensitization steps, to completion of the step of preparing a coating solution, preferably at the step after completing 90% or more by silver amount of silver halide formation, and more preferably at the step after forming tabular silver halide substrate grains and before completing spectral or chemical sensitization.

In preparation of the silver halide emulsion according to the invention, a compound represented by the following formula is preferably employed:

$$A\text{-}\{\text{-}(L)m\text{-}(Z)n\}r \qquad \text{formula (I)}$$

wherein A represents a adsorption group onto silver halide, L represents a divalent or trivalent linkage group, Z represents a substituent, which is capable of releasing a halide ion, m is 0 or 1, n is 1 or 2, and r is an integer of 1 to 3.

Examples of the adsorption group onto silver halide represented by A include a mercapto-containing atomic group residue (e.g., mercaptooxadiazole, mercaptotetrazole, mercaptotriazole, mercaptodiazole, mercaptothiazole, mercaptothiadiazole, mercaptooxazole, mercaptoimidazole, mercaptobenzoxazole, mercaptobenzimidazole, mercaptotetraazaindene, mercaptopyridine, mercaptoquinoline, thiophenol and mercaptonaphthalene residues); a thione group-containing atomic group residue (e.g., thiazoline-2-thione, oxazoline-2-thione, imidazoline-2-thione, benzothiazoline-2-thione, benzoimidazoline-2-thione and thiazoline-2-thione residues); an imino group forming atomic group residue (e.g., triazole, tetrazole, benzotriazole, hydroxyazaindene, benzimidazole and indazole residues); an ethynyl group containing atomic group residue{[e.g., 2-[N-(2-propynyl)amino]benzothiazole, N-(2-propynyl)carbazole}; a meso-ion containing heterocyclic residue (e.g., imidazolium, pyrazolium, oxazolium, thizolium, triazolium, tetrazolium, oxadiazolium, thiatriazolium and oxatriazolium residues). Herein, the meso-ion compound is a group of compounds defined in W. Baker and W. D. Ollis, Quart. Rev. 11, 15 (1957) and Adv. Heterocycl. Chem. 19, 1 (1976), indicating a 5- or 6-membered heterocyclic compound, which can be satisfactorily represented by a single covalent bond structure formula or polar structure formula and having a π-electron sextet related to all atoms forming a cycle, which is positively charged and balanced with the negative charge on an atom or atomic group located outside the cycle.

The group capable of releasing a halide ion, represented by Z is represented preferably by the following formulas In the following, the symbol, "*" represents a bond to L or A; "Hal" represents I, Br or Cl; and "PTS⁻" represents

1)

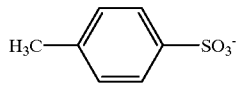

2)

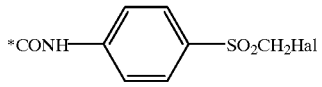

3)

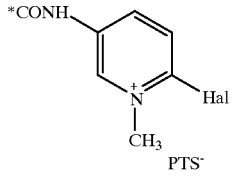

4)

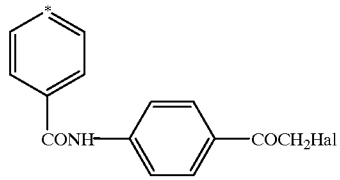

5)

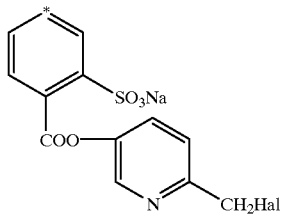

-continued

6)

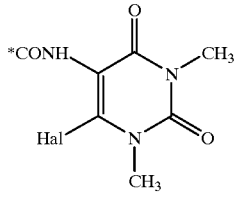

7)

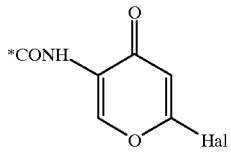

8)

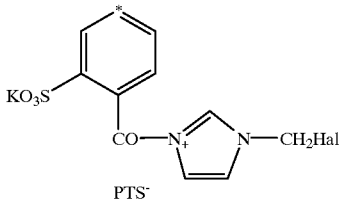

9)

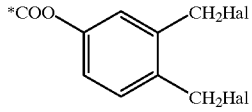

10)

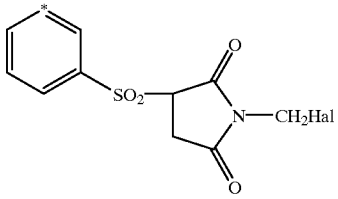

11)

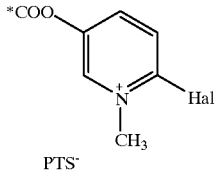

12)

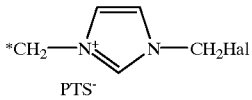

13)

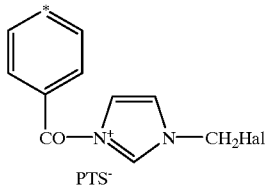

14)

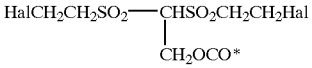

-continued

15)

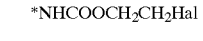

16)

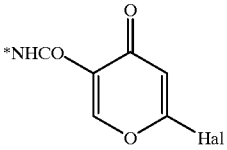

17)

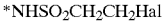

18)

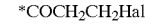

19)

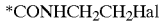

20)

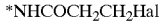

21)

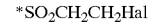

22)

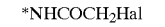

23)

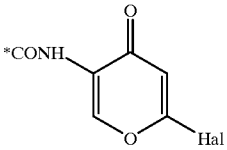

The divalent or trivalent linkage group represented by L is preferably comprised of a carbon atom, hydrogen atom, oxygen atom, nitrogen atom or sulfur atom; and examples thereof include an alkylene group having 1 to 20 carbon atoms (e.g., methylene, ethylene, propylene, hexylene), an arylene group (e.g., phenylene, naphthylene), —$CONR^1$—, $SO_2NR^2$—, —O—, —S—, —$NR^3$—, $NR^4CO$—, $NR^5SO_2$—, —$NR^6CONR^7$, —COO—, —OCO—, —CO— and their combination, in which $R^1$ through $R^7$ each represent a hydrogen atom, an aliphatic hydrocarbon group, an aromatic hydrocarbon group or a heterocyclic group.

The aliphatic hydrocarbon group represented by $R^1$ through $R^7$ includes a straight chained, branched or cyclic alkyl group (e.g., methyl, ethyl, i-propyl, 2-ethylhexyl, cyclopentyl, cyclohexyl), an alkenyl group (e.g., propenyl, 3-pentenyl, 2-butenyl, cyclohexenyl), an alkynyl group (e.g., propargyl, 3-pentynyl), an aralkyl group (e.g., benzyl, phenethyl). The aromatic hydrocarbon group is a 6- to 10-membered, single ring or condensed ring group, including phenyl and naphthyl. The heterocyclic group a 5- to 7-membered, single or condensed ring, which contains a oxygen, sulfur or nitrogen atom, including furyl, thienyl, benzofuryl, pyrroryl, indolyl, thiazolyl, imidazolyl, morpholyl, piperazyl and pyrazyl.

The group represented by $R^1$ through $R^7$ may be substituted. Examples of a substituent include a hydroxy group, a halogen atom (e.g., fluorine, chlorine, bromine, iodine), a cyano group, an amino group (e.g., methylamino, anilino, diethylamino, 2-hydroxyethylamino), an acyl group (e.g., acetyl, benzoyl, propanoyl), a carbamoyl group (e.g., carbamoyl, N-methylcarbamoyl, N,N-tetramethylenecarbamoyl, N-methanesulfonylcarbamoyl, N-acetylcarbamoyl), an alkoxy group (e.g., methoxy, ethoxy, 2-hydroethoxy, 2-methoxyethoxy), an alkoxycarbonyl group (e.g., methoxycarbonyl, ethoxycarbonyl, 2-methoxyethoxycarbonyl), a sulfonyl group (e.g., methanesulfonyl, trifluoromethanesulfonyl, benzenesulfonyl, p-toluenesulfonyl), a sulfamoyl group (e.g., sulfamoyl, N,N-dimethylsulfamoyl, morpholinosulfamoyl, N-ethylsulfamoyl). An acylamino group (e.g., acetoamido, trifluoroacetoamido, benzamido, thienocarbonylamido, benzenesulfonamido) and an alkoxycarbonylamino group (e.g.,) methoxycarbonylamino, N-methyl-ethoxycarbonylamino).

Exemplary examples of the compound represented by formula (I) are shown below but are not limited to these. Compound 1 through 60 each are a compound selectively adsorbable onto a (111) face of silver halide, and Compound 61 through 93 each are a compound selectively adsorbable onto a (100) face of silver halide.

1)

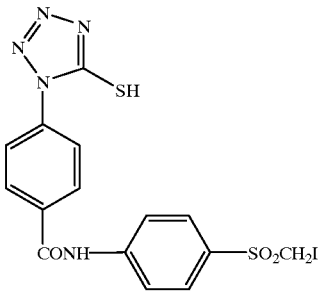

2)

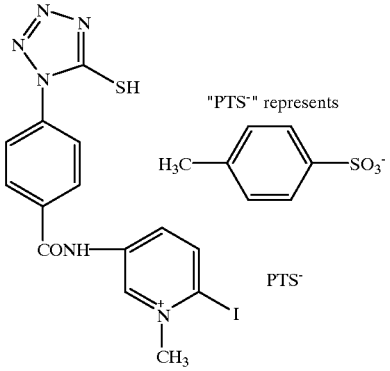

3)

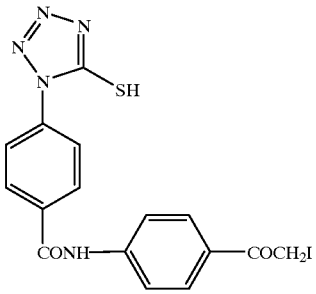

-continued

4)

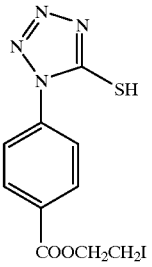

5)

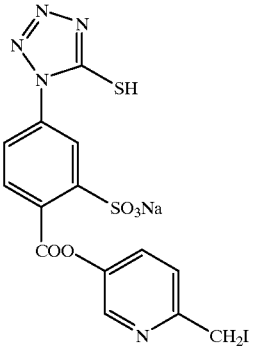

6)

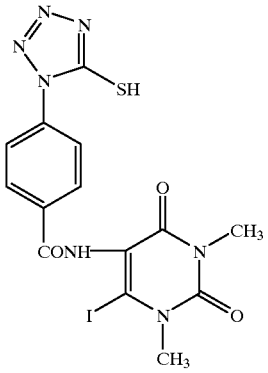

7)

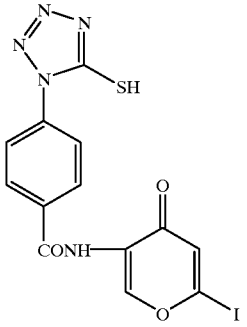

-continued
8)
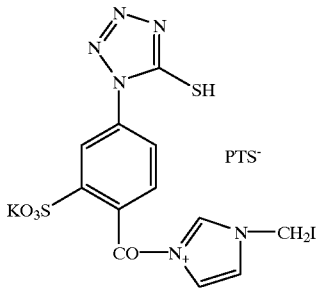
9)
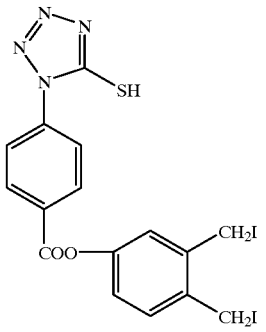
10)
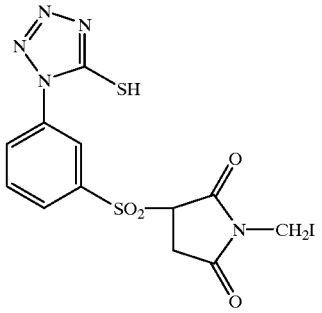
11)
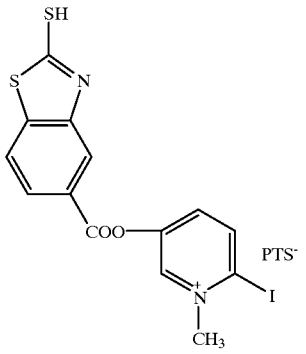
-continued
12)
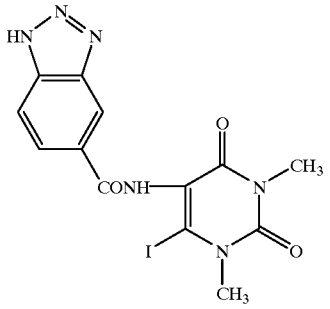
13)
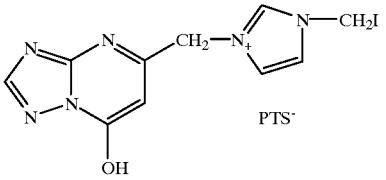
14)
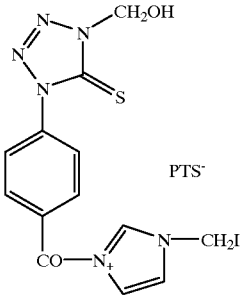
15)
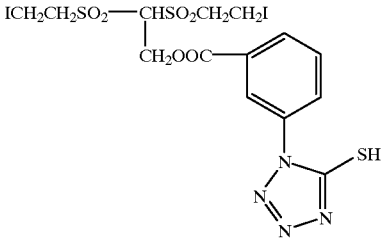
16)
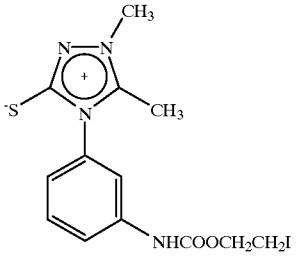

-continued
17)
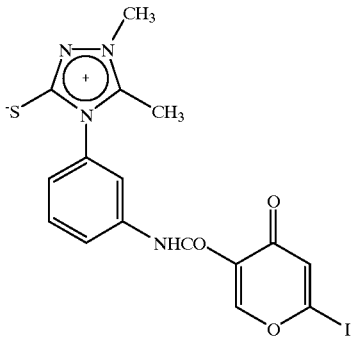
18)
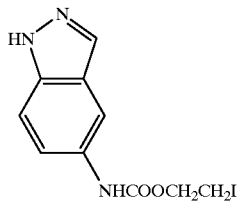
19)
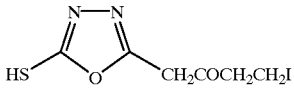
20)
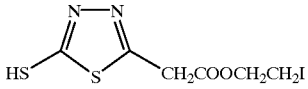
21)
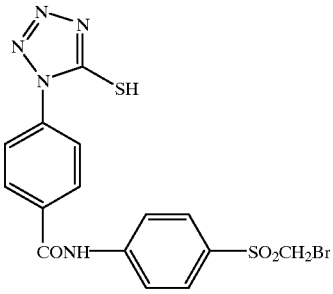
-continued
22)
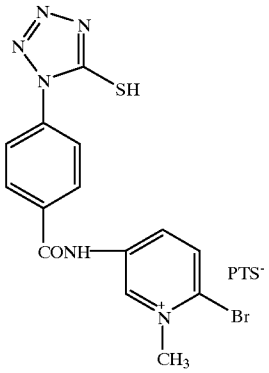
23)
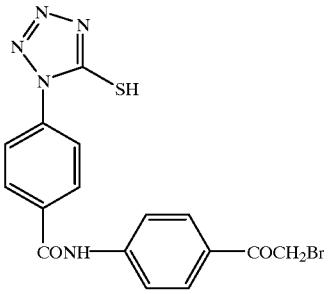
24)
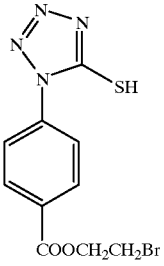
25)
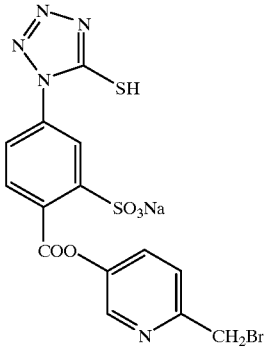

-continued
26)
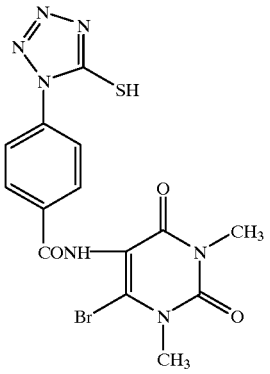
27)
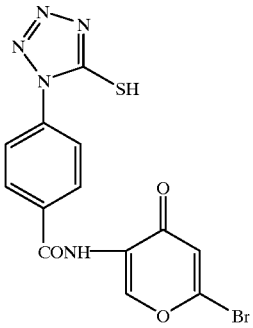
28)
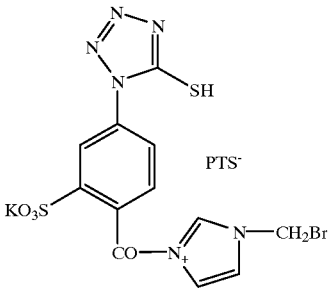
29)
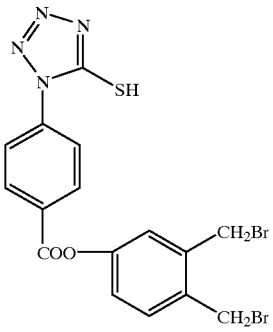
-continued
30)
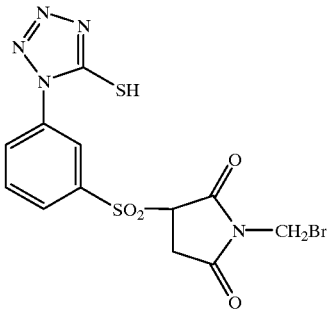
31)
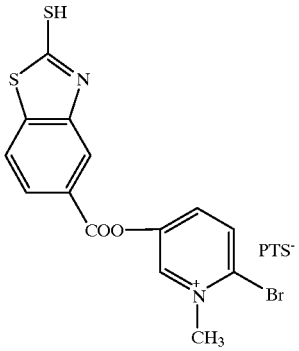
32)
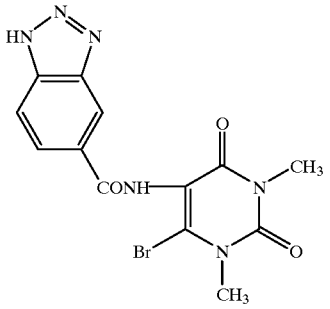
33)
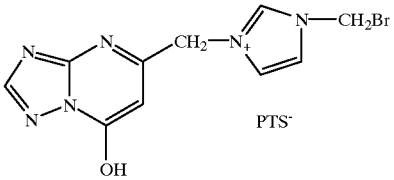
34)
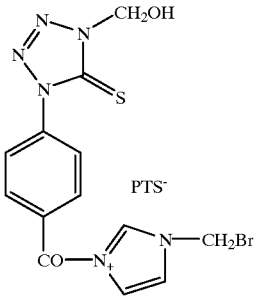

-continued
35)
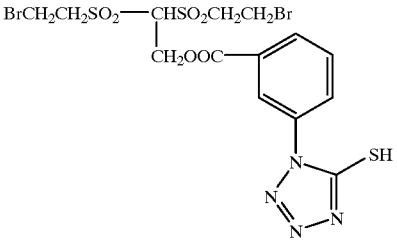
36)
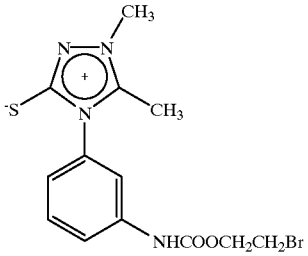
37)
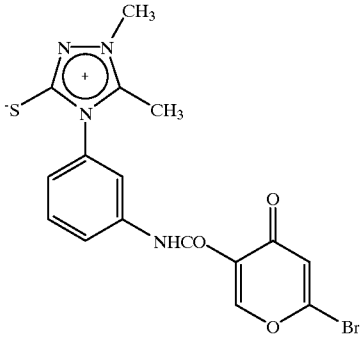
38)
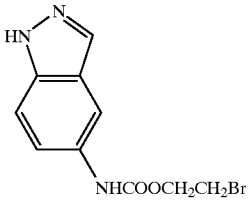
39)
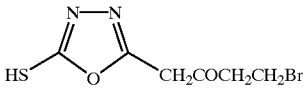
40)
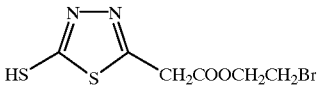
-continued
41)
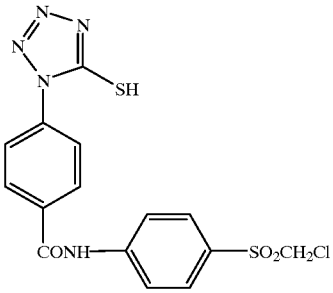
42)
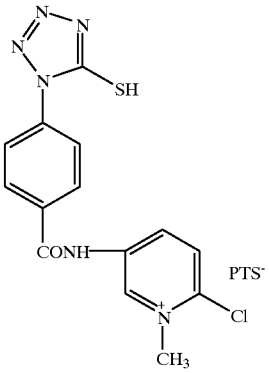
43)
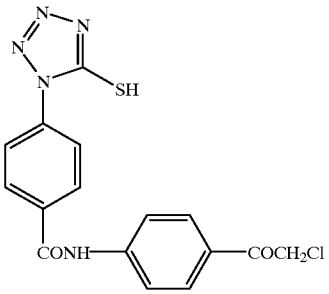
44)
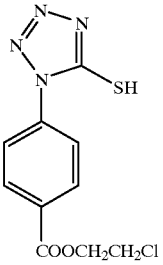

-continued
45)
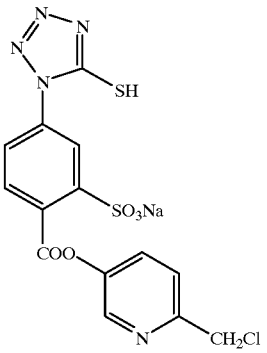
46)
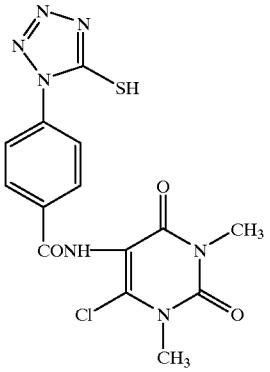
47)
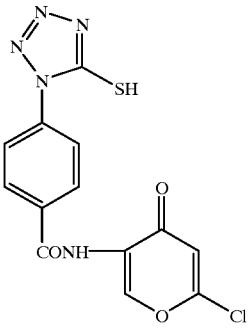
48)
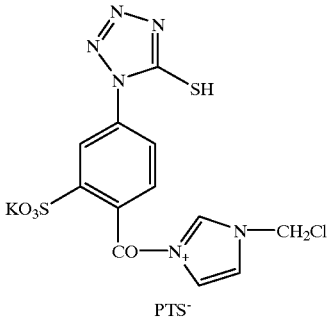
-continued
49)
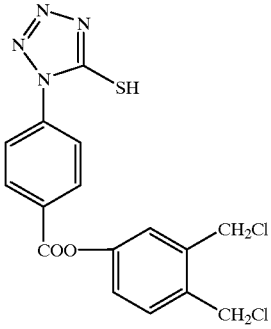
50)
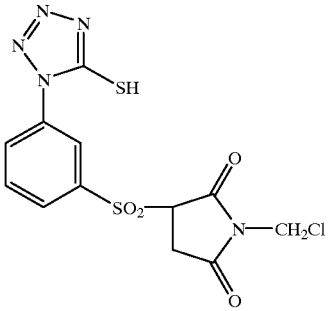
51)
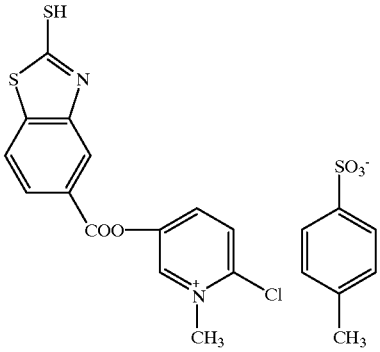
52)
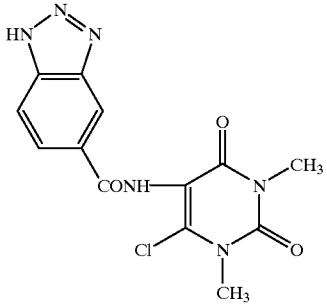
53)
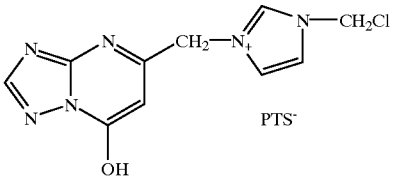

-continued
54)
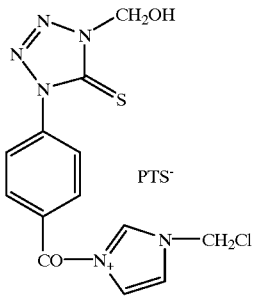
55)
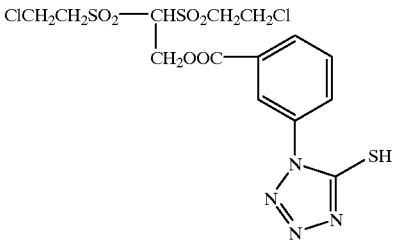
56)
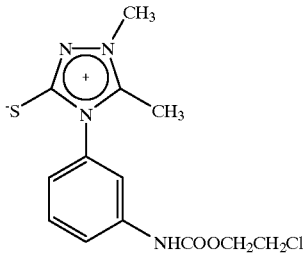
57)
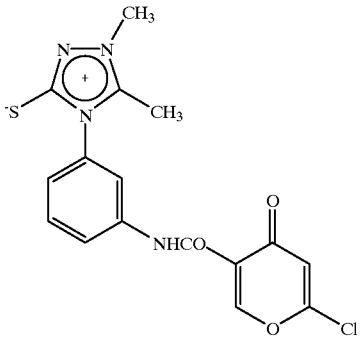
58)
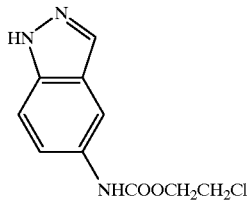
59)
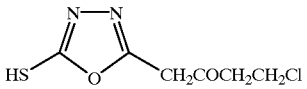
-continued
60)
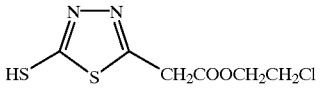
61)
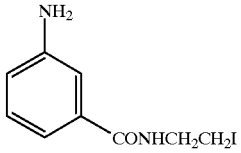
62)
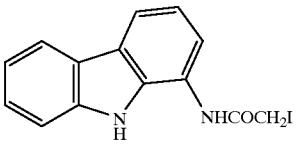
63)
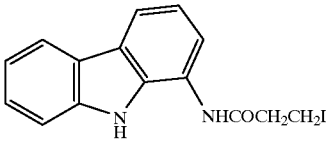
64)
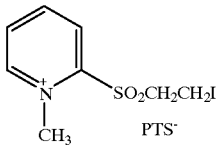
65)
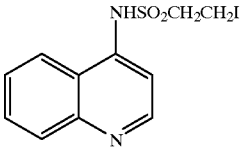
66)
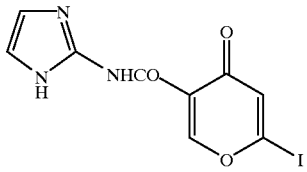
67)
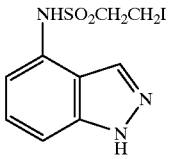
68)
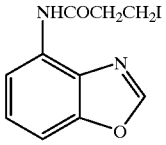

-continued
69)
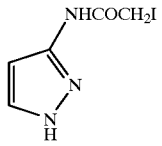
70)
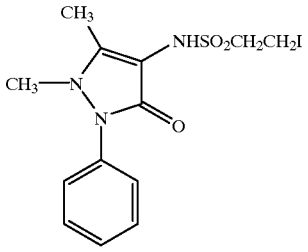
71)
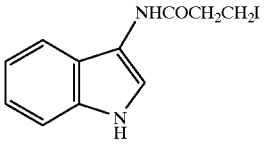
72)
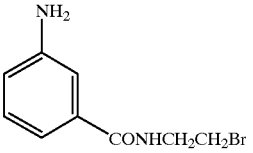
73)
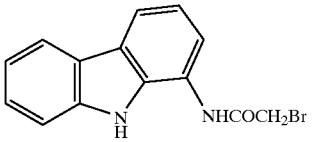
74)
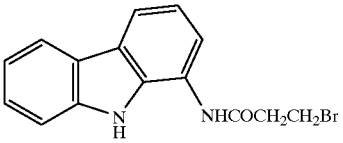
75)
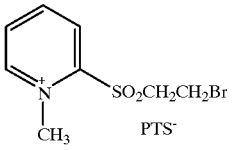
76)
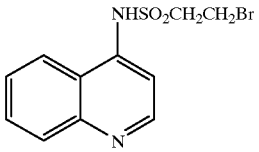
-continued
77)
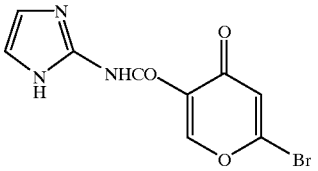
78)
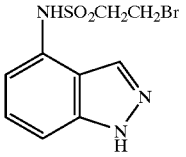
79)
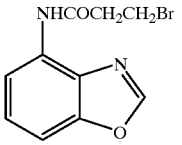
80)
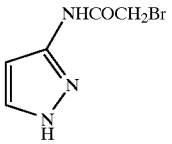
81)
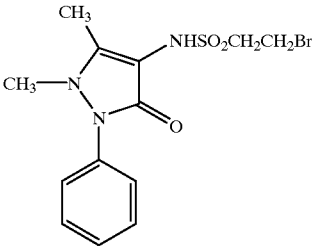
82)
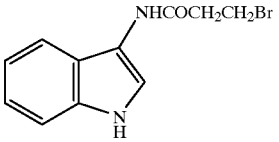
83)
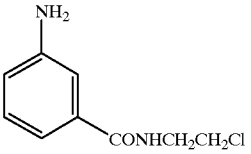
84)
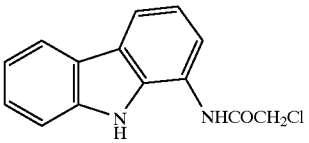

-continued

85)

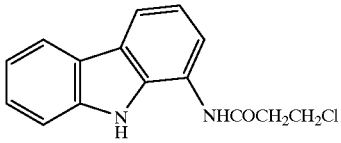

86)

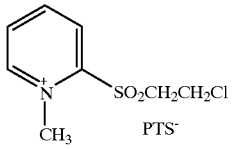

87)

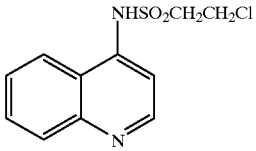

88)

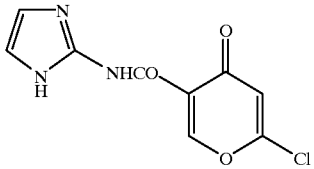

89)

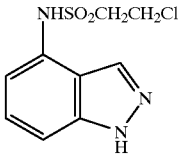

90)

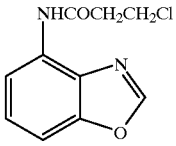

91)

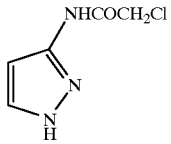

92)

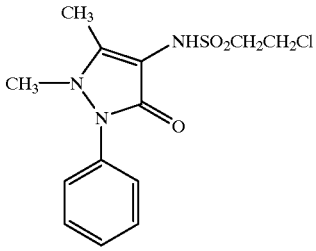

-continued

93)

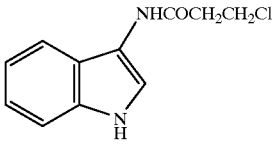

The compound described above can be synthesized employing a known substitution reaction. For example, methods schematically shown below are employed.

(W)—[A]—COOH+Z—$NH_2$→Condensing Agent→(W)—[A]—CONH—Z+$H_2O$ (Eq. 1)

(W)—[A]—$NH_2$+Z—COOH→Condensing Agent→(W)—[A]—NHCO—Z+$H_2O$ (Eq. 2)

(W)—[A]—COCl+Z—$NH_2$→Base→(W)—[A]—CONH—Z+HCl (Eq. 3)

(W)—[A]—$NH_2$+Z—COCl→Base→(W)—[A]—NHCO—Z+HCl (Eq. 4)

(W)—[A]—X+Z—NRH→Base→(W)—[A]—N(R)—Z+HX (Eq. 5)

(W)—[A]—NRH+Z—X→Base→(W)—[A]—N(R)—Z+HX (Eq. 6)

(W)—[A]—X+Z—OH→Base→(W)—[A]—O—Z+HX (Eq. 7)

(W)—[A]—OH+Z—X→Base→(W)—[A]—O—Z+HX (Eq. 8)

(W)—[A]—CHO+Z—$H_2$→Base→(W)—[A]—CH=Z+$H_2O$ (Eq. 9)

(W)—[A]—$H_2$+Z—CHO→Base→(W)—[A]=CH—Z+$H_2O$ (Eq. 10)

In formulas 5, 6, 7 and 8, X is a group capable of being eliminated on reaction, such as a halogen atom (e.g., fluorine, chlorine, bromine, iodine) and a sulfonic acid ester group (e.g., p-toluenesulfonate, trifluoromethanesulfonate, m-chlorobenzenesulfonate).

Exemplary synthesis examples of the compound are shown below.

SYNTHESIS EXAMPLE 1

Synthesis of Exemplified Compound 4

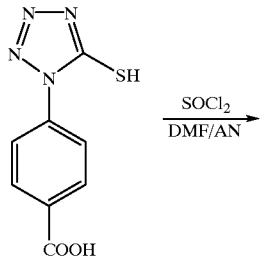

(A)

-continued

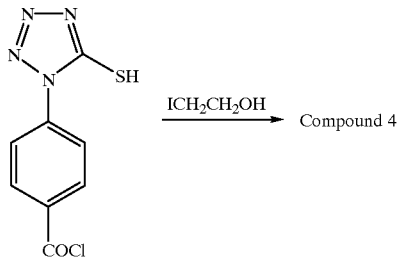

(B)

Compound (A) of 20 g was dispersed in 100 ml of acetonitrile and dissolved by adding 20 ml of dimethylformamide (DMF). After cooling to −5° C., 12.9 g of thionylchloride was slowly ad dropwise added. Then, 16.3 g of iodoethanol was dropwise added, while maintained at the same temperature. After continuing the reaction for 2 hr. at the same temperature, the reaction mixture was concentrated under reduced pressure and the residue was recrystalized in ethanol to obtain an objective product, exemplified Compound 4 of 30.5 g (yield, 90%). The structure was identified by proton NMR and mass spectrum.

SYNTHESIS EXAMPLE 2

Synthesis of Exemplified Compound 16

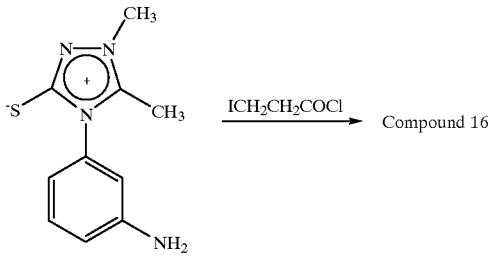

(C)

Compound (C) was dispersed in 150 ml of ethyl acetate and 25 g of iodopropionyl chloride was slowly and dropwise added thereto at room temperature. After completing addition, the reaction mixture was heated under reflux for 3 hr. and then cooled. A precipitate was filtered and recrystalized in methanol to obtain an objective product, exemplified Compound 16 of 35.7 g (yield, 88%). The structure was identified by proton NMR and mass spectrum.

The process of preparing a silver halide photographic emulsion and a silver halide light sensitive photographic material generally comprises the steps of formation of silver halide grains, desalting, spectral sensitization, chemical sensitization, preparation of a coating solution, coating and drying. The compound represented by formula (I) can be used at any step in the process of from the start of silver halide grain formation, thorough grain growth, physical ripening, desalting, spectral sensitization and chemical sensitization stages, to completion of the step of preparing a coating solution.

The silver halide grain formation is the stage from silver halide nucleus grain formation to completion of grain growth and physical ripening. The coating solution preparation is the stage from after completion of silver halide grain growth, physical ripening, and optionally desalting, spectral sensitization and chemical sensitization to the start of coating of a photographic material by the use of the silver halide emulsion related to the invention.

The compound represented by formula (I) can be used at any step in the process of preparing a silver halide emulsion, preferably at any step from after completing 90% or more by silver amount of silver halide formation to completion of desalting, spectral sensitization and chemical sensitization steps, and more preferably at any step after forming tabular silver halide substrate grains and before completing spectral sensitization or chemical sensitization.

When the compound represented by formula (I) is added in the process of preparing a silver halide emulsion, the compound may be directly dispersed in an emulsion or dissolved in a single or mixed solvent, such as water, methanol or ethanol, and any method known in the art of adding an additive to a silver halide emulsion can be applicable. The compound represented by formula (I) can be added preferably in an amount of $1\times10^{-7}$ to 30 mol %, and more preferably $1\times10^{-6}$ to 5 mol % per mol of silver halide.

The compound represented by formula (I) may be used by adding to the silver halide emulsion and after addition, optionally allowed to release a halide ion upon reaction with a base and/or a nucleophilic agent. The base and nucleophilic agent may be used in combination. Examples of the nucleophilic agent usable in the invention include a hydroxide ion, a sulfite ion, hydroxyamines, hydroxamic acids, a metabisulfite ion, a thiosulfate ion, oximes, mercaptans, a sulfinate, a carboxylate, an ammonium compound, an amine compound, phenols, alcohols, thioureas, ureas, hydrazines, sulfides and phosphines. Of these, an alkali metal hydroxide is preferred. Timing or the rate of releasing a halide ion can be controlled by the method of adding the nucleophilic agent or base, the concentration or the reaction temperature. The concentration of the base and/or nucleophilic agent is preferably $1\times10^{-7}$ to 50 mol, more preferably $1\times10^{5}$ to 10 mol, and still more preferably $1\times10^{-3}$ to 5 mol. The temperature is preferably 20 to 90° C., more preferably 30 to 85° C., and still more preferably 35 to 80° C. In cases where a base is used for releasing a halide ion, the pH may be controlled. The pH is preferably 2 to 12, and more preferably 3 to 11. The halide ion released is preferably 0.001 to 30 mol % and more preferably 0.01 to 10 mol % of total silver halide. The compound represented by formula (I) may release all or a part of halide atom(s) contained in the compound. The halide ion released from the compound represented by formula (I) is preferably a chloride ion, bromide ion or iodide ion, more preferably a bromide ion or iodide ion, and still more preferably an iodide ion. The compound represented by formula (I) may be used singly or in combination.

The adsorption group of formula (I) preferably has selective adsorbability onto the major surface of silver halide grains. Having selective adsorbability onto the major surface of silver halide grains means that when an absorption isotherm to silver halide grains is studied, adsorption onto a crystal face constituting the major surface is larger as compared to other crystal faces of the silver halide grain surface. These adsorption properties can be referred to T. H. James, The Theory of the Photographic Process, Fourth Edition, Macmillan, N.Y., 1977, Chapters 9, 1, and 13; A. Herz and J. Helling, J. Colloid Interface Sci., 22, 391 (1966); and S. L. Scrutton, J. Phot. Sci. 22, 69 (1974).

The crystal face can be crystallographically represented in terms of Miller indices. As is recognized in the art, a cubic silver halide grain is mainly comprised of (100) faces, an octahedral grain is mainly comprised of (111) faces, and as to the tabular silver halide grains, ones mainly comprised of (100) faces or ones mainly comprised of (111) faces are optionally prepared.

The major surface according to the invention refers to the silver halide grain surface comprised of crystal face occupying the largest area among surfaces of the silver halide grain. The crystal face constituting the major surface can be distinguished by observing silver halide grains using an electronmicroscope at a magnification of 10,000 to 50,000 times. When intended to know the crystal face constituting ratio further in detail, for example, measurement by the use of a sensitizing dye having adsorbability onto the silver halide surface which depends of the crystal faces can be applied. The area ratio of (100) face to (111) face constituting the silver halide grain surface can be determined by the method described in T. Tani, Journal of Imaging Science 29, 165 (1985). Thus, reaction spectrum of a thick liquid emulsion layer to which a sensitizing dye [anhydro-3,3'-bis (4-sulfobutyl)-9-methylthiacarbocyanine hydroxide.pyridium salt] is added in various amounts, is measure. In light of the fact that the dye gives markedly different spectra between being on the (100) face and being on the (111) face, the ratio of (100) face to (111) face can be determined using Kubelka-Munk equation.

The adsorption group of the compound of formula (I), after adsorbed to silver halide and releasing all or a part of halide ions, may be desorbed from silver halide. Desorption can be made by the method of employing protonation by referring to JP-A 5-265111 and 6-161005, or by exchange adsorption using a sensitizing dye or a compound which contains an adsorption group having stronger adsorbability to silver halide than the adsorption group of the compound (I). These methods can be employed in combination.

The tabular silver halide grains as substrate grains can be formed by various methods known in the art. Thus, the single jet addition, the double jet addition, the triple jet addition or the fine silver halide grain supplying method can be employed singly or in combination. Further, a method in which the pH and pAg in a liquid phase of forming silver halide grains are controlled in proportion to the growth rate of silver halide grains, is also employed in combination.

A seed grain emulsion can be employed to form the silver halide emulsion according to the invention. Silver halide grains of the seed emulsion may have a regular crystal structure such as cubic form, octahedral form and tetradecahedral form or an irregular crystal structure such as spherical or tabular form. The ratio of (100) face to (111) face of the grains is optional. The grains may be a composite of these crystal forms or a mixture of various crystal form grains. The silver halide grains of the seed emulsion are preferably twinned crystal grains having at least one twin plane, and more preferably twinned crystal grains having two parallel twin planes.

In any cases where the seed emulsion is employed or not, methods known in the art can be applied to the conditions for silver halide nucleation and ripening.

Although a silver halide solvent known in the art may be employed in preparation of a silver halide emulsion, it is preferred to avoid the use of the silver halide solvent in formation of the tabular silver halide gains as substrate grains, except for ripening after each formation. Examples of the silver halide solvent include (a) organic thioethers described in U.S. Pat. Nos. 3,217,157, 3,531,289, 3,574,628 and JP-B 58-30571; (b) thiourea derivatives described in JP-A 53-82408, 55-29829 and 57-77736; (c) a silver halide solvent having a thiocarbonyl group interposing between a oxygen or sulfur atom and a nitrogen atom, described in JP-A 53-144319; (d) imidazoles described in JP-A 54-100717; (e) sulfites; (f) thiocyanates; (g) ammonia; (h) ethylendiamines substituted by a hydroxyalkyl group, described in JP-A 57-196228; (i) substituted mercaptotetrazoles described in JP-A 57-202531, (j) aqueous soluble bromides; and (k) benzimidazole derivatives described in JP-A 58-54333.

To preparation of silver halide emulsions can be applied any one of acidic precipitation, neutral precipitation and ammoniacal precipitation, and acidic or neutral precipitation is preferably employed. In the silver halide preparation, a halide ion and a silver ion may be simultaneously added, or any one of them may be added into the other one. Taking into account the critical growth rate of silver halide crystals, the halide and silver ions can be added successively or simultaneously while controlling the pAg and pH within the reaction vessel. Halide composition of silver halide grains can be varied by a halide conversion method at any stage during the course of forming silver halide grains.

Using at least one selected from a cadmium salt, a zinc salt, a lead salt, thallium salt, a iridium salt (including its complex salt), a rhodium salt (including its complex salt), a iron salt or other VIII group metal salts (including their complex salts), a metal may be added to allow the metal to be occluded (or doped) in the interior and/or exterior of silver halide grains.

A dispersing medium in the silver halide emulsion according to the invention is a substance capable of forming a protective colloid, gelatin is preferably employed. Gelatin used as the dispersing medium includes an alkali processed gelatin, an acid processed gelatin, and a deionized gelatin Preparation of gelatin is described in detail in A. Veis, The Macromolecular Chemistry of Gelatin, Academic Press, 1964. Examples of the protective colloid forming substance other than gelatin include gelatin derivatives, a graft polymer of gelatin and other polymers, proteins such as albumin or casein; cellulose derivatives such as hydroxyethyl cellulose, carboxymethyl cellulose and cellulose sulfuric acid ester; saccharide derivatives such as sodium alginate or starch derivatives; a synthetic or semi-synthetic hydrophilic polymer such as polyvinyl alcohol, polyvinyl alcohol partial acetal, poly-N-vinylpyrrolidone, polyacrylic acid, polyacrylamide, polyvinyl imidazole or polyvinyl pyrazole, including their copolymer.

The silver halide emulsion can be subjected to reduction sensitization using a method known in the art. The reduction sensitization may be performed during the stage of forming silver halide grains or after the grain formation. Exemplary examples of the method of reduction sensitization include a method in which silver halide grains are ripened or grown at a low pAg by supplying silver ions (or so-called silver ripening), a method of ripening at a high pH by using an alkaline material and a method of adding a reducing agent. Examples of the reducing agent include thiourea dioxide, ascorbic acid or its derivative, a stannous salt, a borane compound, formamidine, sulfinic acid, silane compound, an amine or polyamine, and a sulfite. Of these, thiourea dioxide, ascorbic acid or its derivative or a stannous salt is preferably employed.

Known oxidizing agents can also be employed in the preparation of silver halide emulsions. Examples of the oxidizing agent include hydrogen peroxide (solution) or its adduct, such as $H_2O_2$, $NaBO_2$, $H_2O_2$-$3H_2O$, $2Na_2CO_3$-$3H_2O_2$, $Na_4P_2O_7$-$2H_2O_2$, and $2Na_2SO4$-$H_2O_2$-$2H_2O$; peroxyacid salts such as $K_2S_2O_3$, $K_2C_2O_3$, $K_4P_2O_3$, $K_2$[Ti(O)

$_2C_2O_4]$-$3H_2O$, peracetic acid, ozone and a thiosulfonic acid compound. The reducing agent and the oxidizing agent can be employed in combination.

In cases where fine silver halide grains are employed in the invention, the fine silver halide grains may be prepared prior to or concurrently to the preparation of the silver halide emulsion according to the invention. When concurrently prepared, as described in JP-A 1-183417 and 2-44335, the fine silver halide grains can be prepared in a mixing vessel provided outside a reaction vessel in which silver halide emulsion relating to the invention is prepared. In this case, it is preferred that a preparation vessel is provided separately from the mixing vessel, a preparation vessel is provided, in which fine silver halide grains prepared in the mixing vessel is optimally prepared so as to be suitable for growth environment in the reaction vessel and then supplied to reaction vessel.

The fine silver halide grains are preferably prepared preferably under an acidic or neutral environment (pH≦7). The fine silver halide grains can be prepared by mixing a silver ion containing aqueous solution and a halide ion containing aqueous solution while optimally controlling supersaturation parameter(s). The control of the supersaturation parameter is referred to the description in JP-A 63-92942 and 63-311244. To prevent production of reduced silver nuclei, the fine silver halide grains are prepared preferably at a pAg of not less than 3.0, more preferably not less than 5.0, and still more preferably not less than 8.0. The fine silver halide grains are prepared preferably at a temperature of 50° C. or less, more preferably 40° C. or less, and still more preferably 35° C. or less. As a protective colloid used in the preparation of the fine silver halide grains can be employed the afore-mentioned protective colloid forming substances used in the preparation of the silver halide emulsion according to the invention. In the case when the fine silver halide grains are prepared at a low temperature, a grain size increase due to Ostwald ripening can be prevented but gelatin is liable to gel at a low temperature, so that a low molecular weight gelatin described in JP-A 2-166422 a synthetic polymer compound or a natural polymer compound other than gelatin, which has protective colloidal action onto silver halide grains, is preferably employed. The concentration of the protective colloid is preferably not less than 1% by weight, more preferably not less than 2%, and still more preferably 3%. The diameter of the fine silver halide grains is preferably not more than 0.1 μm, and more preferably not more than 0.05 μm. The fine silver halide grains may optionally be subjected to reduction sensitization or doped with a metal ion.

During or after forming silver halide grains, it is preferred to perform desalting to prevent physical ripening or remove unnecessary salts. Specifically, in cases where fine silver halide grains are employed to prepare a silver halide emulsion, it is preferred to employ a previously desalted fine silver halide grains, and when forming the outermost layer of silver halide grains, it is preferred to subject to desalting for each formation of silver halide layers. Desalting can be carried out, for example, according to the method described in Research Disclosure (hereinafter, also denoted as "RD") 17643 Sect. II. Thus, a noodle washing method by gelling gelatin or a flocculation method by the use of an inorganic salt, an anionic surfactant, an anionic polymer (e.g., polystyrene sulfonic acid) or a gelatin derivative (e.g., acylated gelatin, carbamoyled gelatin) is preferably employed to remove unnecessary salts from precipitates or a physical-ripened emulsion. Desalting by employing membrane separation, as described in Kagaku Kogaku Binran (Handbook of Chemical Engineering) 5th Edition, page 924–954, edited by Kagakukogaku Kyokai and published by Maruzen. The membrane separation method can further be referred to RD 10208 and 13122; JP-B 59-43727 and 62-27008; JP-A57-209823, 59-43727, 61-219948, 62-2303562-113137, 63-40039, 63-40137, 2-172816, 2-172817, 3-140946 and 4-22942. Conditions other than those described above can be optimally selected by reference to JP-A 61-6643, 61-14630, 61-112142, 62-157024, 62-18556, 63-92942, 63-151618, 63-163451, 63-220238 and 63-311244; RD 36736 and 39121.

A silver halide emulsion, which has been subjected to physical ripening, chemical sensitization and spectral sensitization, is employed to prepare the silver halide light sensitive photographic material according to the invention. Additives used in these processes are described in RD 17643 page 23 Sect.III to page 24 Sect.VI-M, RD 18716 page 648–649, and RD 308119 page 996 Sect.III to page 1000 Sect.VI-M.

Known photographic additives used in the invention are described in RD 17643 page 25 Sect. VIII-A to page 27 Sect.XIII, RD 18716 page 650–651, and RD 308119 page 1003 Sect.VIII to page 1012 Sect.XXI-E.

In color photographic materials can be employed a variety of couplers. Examples thereof are described in RD 17643 page 25 Sect.VII-C to G and RD 308119 page 1001 Sect.VII-C to G.

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer as described in RD 308119 VII-K, and may have a layer arrangement, such as normal layer order, reversed layer order or unit constitution.

The present invention can be applied to a variety of color photographic materials, including a color negative film for general use or cine use, color reversal film for slide or television, color paper, color positive film, and color reversal paper.

The photographic material relating to the invention can be processed in accordance with conventional methods, as described in RD 17643 pages 28–29 Sect.XIX, RD 18716 page 651, and RD 308119 page 1010–1011 Sect.XIX.

EXAMPLES

The present invention is further explained based on examples, but embodiments of the present invention are by no means limited to these examples.

Example 1

Preparation of Seed Emulsion T-1

A seed grain emulsion, T-1 having two parallel twin planes was prepared according the following procedure.

| E-1 Solution | |
|---|---|
| Deionized alkali-treated gelatin (Weight-averaged mean molecular weight 15,000) | 244.0 g |
| Potassium bromide | 156.6 g |
| 10% Surfactant (EO-1) methanol solution | 0.48 ml |
| Water to make | 34.0 l |

-continued

| | |
|---|---|
| EO-1: $HO[(CH_2CH_2O)m(CH(CH_3)CH_2O]_{19.8}(CH_2CH_2O)nH$ (m + n = 9.77) | |
| F-1 Solution | |
| Silver nitrate | 1200 g |
| Water to make | 3716 ml |
| G-1 Solution | |
| Deionized alkali-treated gelatin (Weight-averaged mean molecular weight 15,000) | 31.6 g |
| Potassium bromide | 906.0 g |
| Water to make | 4.0 l |
| H-1 Solution | |
| Ammonia water (28%) | 299 ml |
| I-1 Solution | |
| Water | 8.0 l |
| J-1 Solution | |
| Ossein gelatin | 400.0 g |
| Water to make | 4832 ml |
| K-1 Solution | |
| Potassium bromide | 69.2 g |
| Water to make | 386 ml |
| L-1 Solution | |
| Aqueous 56 wt. % acetic acid solution | 1000 ml |

To solution E-1 with vigorously stirring at 30° C. by the use of a stirrer described in JP-A 62-160128 was added solution I-1 and then, solutions F-1 and G-1 were added by the double jet addition for a period of 2 min. to form silver halide nucleus grains. Subsequently, solution J-1 was added thereto and after the temperature was raised to 68° C. in 41 min., solution H-1 was further added and ripening was carried out for 5 min. Then solution K-1 was added and after 1 min., the pH was adjusted to 4.7 with solution L-1 and the emulsion was immediately desalted. From electron microscopic observation of the resulting seed emulsion, it was proved that the was comprised of monodispersed silver halide seed grains having two parallel twin planes, an average grain diameter (equivalent circle diameter) of 0.31 μm and a grain diameter distribution of 16%.

Preparation of Comparative Emulsion Em-1

Using the following solutions was prepared a comparative emulsion (Em-1).

| | |
|---|---|
| H-2 Solution | |
| Ossein gelatin | 223.6 g |
| 10% Surfactant (EO-1) methanol solution | 3.6 ml |
| Seed emulsion (T-1) | 0.774 mol equivalent |
| Water to make | 5904 ml |
| I-2 Solution | |
| 3.5N silver nitrate aqueous solution | 7265 ml |
| J-2 Solution | |
| Potassium bromide | 3674 g |
| Potassium iodide | 104.6 g |
| water to make | 9000 ml |
| L-2 Solution | |
| 1.75N potassium bromide aqueous solution | necessary amount |
| M-2 Solution | |
| 56 wt. % acetic acid aqueous solution | necessary amount |

To a reaction vessel was added solution H-2 and solutions I-2 and J-2 were added with vigorously stirring by the double jet addition, as shown in Table 1, so that the solution J-2 was equimolar to the solution I-2, and the seed grains were allowed to grow to prepare a tabular silver halide grain emulsion. Herein, taking into account a critical growth rate, solutions I-2 and J-2 were added at an accelerated flow rate so that production of fine grains other than growing seed grains and widening of grain diameter distribution due to Ostwald ripening between growing grains did not occur. Grain growth was performed in a manner such that the first addition was conducted, while the temperature and pAg of a solution within a reaction vessel were controlled at 75° C. and 8.8, respectively, thereafter, the temperature was raised to 60° C. in 15 min. and then the second addition was conducted while controlled at a temperature of 60° C., a pAg of 9.8 and a pH of 5.8. The pAg and pH were each controlled by adding solutions L-2 and M-2. after completing grain formation, the emulsion was desalted according to the procedure described in JP-A 5-72658 and redispersed by adding gelatin thereto to obtain an emulsion with a pAg of 8.06 and a pH of 5.8. From electron microscopic observation of silver halide emulsion grains, it was proved that the resulting emulsion was comprised of monodispersed, hexagonal tabular silver halide grains having an average diameter of 1.40 μm, a grain diameter distribution of 16% and an average aspect ratio of 9.0.

TABLE 1

| Added solution | Add. time (min) | Added silver amount (%) | Iodide content* (mol %) | Remark |
|---|---|---|---|---|
| I-2 | 0.00 | 0.0 | 2.0 | 1st |
| J-2 | 16.20 | 5.0 | 2.0 | Addition |
| | 29.02 | 10.0 | 2.0 | |
| | 49.19 | 20.0 | 2.0 | |
| | 77.39 | 40.0 | 2.0 | |
| | 100.00 | 66.0 | 2.0 | |
| I-2 | 113.32 | 68.0 | 2.0 | 2nd |
| J-2 | 127.91 | 80.0 | 2.0 | Addition |
| | 133.94 | 90.0 | 2.0 | |
| | 139.75 | 100.0 | 2.0 | |

*An iodide content of an added halide solution

Preparation of Comparative Emulsion Em-2

Emulsion Em-2 was prepared in the same manner as emulsion Em-1, except that prior to desalting, solution K-2 was added in an amount corresponding to 1.5 mol % of total silver halide. Herein, "total silver halide" refers to the total silver halide contained in the reaction mixture prior to addition of the solution K-2.

Solution K-2

Fine grain emulsion* comprised of 3.0 wt. % gelatin and fine silver iodide grains (average diameter of 0.05 μm)

Preparation

To 5000 ml of a 6.0 wt. % gelatin aqueous solution containing 0.06 mol potassium iodide was added 2000 ml of an aqueous solution containing 7.06 mol silver nitrate and 2000 ml of an aqueous solution containing 7.06 mol potassium iodide at a constant flow rate for 10 min. During addition, the pH and temperature were maintained at 2.0 with nitric acid and at 40° C. After completing addition, the pH was adjusted to 6.0 with a sodium carbonate aqueous solution. The final weight was 12.53 kg.

Preparation of Inventive Emulsion Em-3

Emulsion Em-3 of the present invention was prepared in the same manner as emulsion Em-1, except that after desalting, the temperature was raised to 60° C., the pBr was adjusted to 1.3 with a 2N potassium bromide aqueous solution, solution N-2 described below was added in an amount corresponding to 2 mol % of the total silver amount, ripened for 30 min., subjected to ultrafiltration A, thereafter, the temperature was again raised to 60° C., the pBr was adjusted to 1.1 with a 2N potassium bromide aqueous solution, then, solution O-2 described below was added in an amount of 1 mol %, based on total silver halide and ripening was continued further for 10 min.

Solution N-2

Fine grain emulsion* comprised of 3.0 wt. % gelatin and fine silver iodobromide grains (average diameter of 0.08 μm and iodide content of 20 mol %)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 5.65 mol potassium bromide and 1.41 mol potassium iodide at a constant flow rate for 10 min. During addition, the pH and temperature were maintained at 3.0 with nitric acid and at 30° C. After completing addition, the pH was adjusted to 6.0 with a sodium carbonate aqueous solution.

Solution O-2

Fine grain emulsion* comprised of 3.0 wt. % gelatin and fine silver bromide grains (average diameter of 0.05 μm)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 7.06 mol potassium bromide at a constant flow rate for 10 min. During addition, the pH and temperature were maintained at 3.0 with nitric acid and at 30° C. After completing addition, the pH was adjusted to 6.0 with a sodium carbonate aqueous solution.

Ultrafiltration A

A silver halide emulsion was passed through a ultrafiltration module (Type ALP-1010 using a polyacrylonitrile with partitioned molecular weight of 13,000, produced by Asahi Kasei), cycled with repeating addition of water and concentration and finally, the pBr was adjusted to 3.0 at 40° C.

Preparation of Inventive Emulsion Em-4

Emulsion Em-4 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.5 with a 2N potassium bromide aqueous solution, solution P-2 described below was added in an amount corresponding to 2 mol % of the total silver amount, ripened for 30 min., subjected to the ultrafiltration A, thereafter, the temperature was again raised to 60° C., the pBr was adjusted to 1.1 with a 2N potassium bromide aqueous solution, then, solution O-2 described above was added in an amount of 2 mol %, based on total silver halide and ripening was continued further for 10 min.

Solution P-2

Fine grain emulsion comprised of 3.0 wt. % gelatin and fine silver iodobromide grains (average diameter of 0.05 μm and iodide content of 10 mol %)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 6.35 mol potassium bromide and 0.71 mol potassium iodide at a constant flow rate for 10 min. During addition, the pH and temperature were maintained at 3.0 with nitric acid and at 30° C. After completing addition, the pH was adjusted to 6.0 with a sodium carbonate aqueous solution.

Preparation of Inventive Emulsion Em-5

Emulsion Em-5 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.7 with a 2N potassium bromide aqueous solution, solution Q-2 described below was added in an amount corresponding to 1 mol % of total silver halide, ripened for 30 min., subjected to the ultrafiltration A, thereafter, the temperature was again raised to 60° C., the pBr was adjusted to 1.1 with a 2N potassium bromide aqueous solution, then, solution R-2 described below was added in an amount of 1% per silver halide and ripening was continued further for 10 min.

Solution Q-2

Fine grain emulsion* comprised of 3.0 wt. % gelatin and fine silver iodobromide grains (average diameter of 0.05 μm and iodide content of 7 mol %)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 6.57 mol potassium bromide and 0.49 mol potassium iodide at a constant flow rate for 10 min. During addition, the pH and temperature were maintained at 3.0 with nitric acid and at 30° C. After completing addition, the pH was adjusted to 6.0 with a sodium carbonate aqueous solution.

Solution R-2

Fine grain emulsion* comprised of 3.0 wt. % gelatin and fine silver bromide grains (average diameter of 0.05

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 7.06 mol potassium bromide at a constant flow rate for 10 min. During addition, the pH and temperature were maintained at 3.0 with nitric acid and at 30° C. After completing addition, the pH was adjusted to 6.0 with a sodium carbonate aqueous solution.

Preparation of Inventive Emulsion Em-6

Emulsion Em-6 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.7 with a 2N potassium bromide aqueous solution, solution Q-2 described above was added in an amount corresponding to 0.5 mol % of the total silver halide amount, ripened for 30 min., subjected to the ultrafiltration A, thereafter, the temperature was again raised to 60° C., the pBr was adjusted to 1.1 with a 2N potassium bromide aqueous solution, then, solution R-2 described above was added in an amount of 2 mol % of total silver halide, the emulsion was ripened further for 10 min and then subjected to the ultrafiltration A described above.

Preparation of Inventive Emulsion Em-7

Emulsion Em-7 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.1 with a 2N potassium bromide aqueous solution, solution R-2 described above was added in an amount corresponding to 3 mol % of total silver halide, ripened for 30 min., subjected to the ultrafiltration A, thereafter, the temperature was again raised to 60° C., solution S-2 described below was added in an amount of 40 ml per mol of silver halide, after 10 min., the pBr was adjusted to 1.6 with a 2N potassium bromide aqueous solution, then, solution U-2 described below was added in an amount of 1 mol % of total silver halide, the emulsion was ripened further for 10 min and then subjected to the ultrafiltration A described above.

Solution S-2

10% surfactant (EO-1) methanol solution

Solution U-2

Fine grain emulsion* comprised of 3.0 wt. % gelatin and fine silver iodobromide grains (average diameter of 0.05 μm and iodide content of 10 mol %)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 6.35 mol potassium bromide and 0.71 mol potassium iodide at a constant flow rate for 10 min. During addition, the pH and temperature were maintained at 3.0 with nitric acid and at 30° C. After completing addition, the pH was adjusted to 6.0 with a sodium carbonate aqueous solution and subsequently, the emulsion was subjected to the Ultrafiltration A described above.

Preparation of Inventive Emulsion Em-8

Emulsion Em-8 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.1 with a 2N potassium bromide aqueous solution, solution R-2 described above was added in an amount corresponding to 2 mol % of total silver halide, ripened for 20 min., subjected to the ultrafiltration A, thereafter, the temperature was again raised to 60° C., solution S-2 described above was added in an amount of 20 cc per mol of silver halide, after 10 min., exemplified Compound 4) was added in an amount of $1.6\times10^{-4}$ mol % of total silver halide and then subjected to the ultrafiltration A described above.

Preparation of Inventive Emulsion Em-9

Emulsion Em-9 of the present invention was prepared in the same manner as emulsion Em-1, except that in place of desalting according to JP-A 5-72658, the emulsion was subjected to the ultrafiltration A described above, the temperature was raised to 60° C., the pBr was adjusted to 1.1 with a 2N potassium bromide aqueous solution, solution R-2 described above was added in an amount corresponding to 2 mol % of total silver halide, ripened for 20 min., subjected to the ultrafiltration A, thereafter, the temperature was again raised to 60° C., Pluronic TM-31R1 (available from BASF) was added in an amount of 5 g per mol of silver halide, after 10 min., exemplified Compound 16) was added in an amount of $2.0\times10^{-4}$ mol % of total silver halide and then subjected to the ultrafiltration A described above.

Preparation of Inventive Emulsion Em-10

Emulsion Em-10 of the present invention was prepared in the same manner as emulsion Em-1, except that in the first addition during grain formation, the pAg was maintained at 9.4, after grain formation, the emulsion was subjected to the ultrafiltration A described above in place of desalting according to JP-A 5-72658, the temperature was raised to 60° C., the pBr was adjusted to 1.7 with a 2N potassium bromide aqueous solution, solution Q-2 described above was added in an amount corresponding to 0.5 mol % of total silver halide, ripened for 30 min., subjected to the ultrafiltration A, thereafter, the temperature was again raised to 60° C., the pBr was adjusted to 1.1 with a 2N potassium bromide aqueous solution, solution R-2 described below was added in an amount of 2 mol % of total silver halide, and the emulsion was ripened for 10 min. and then subjected to the ultrafiltration A described above. From electron microscopic observation of silver halide emulsion grains, it was proved that the resulting emulsion was comprised of monodispersed, hexagonal tabular silver halide grains having an average diameter of 1.85 μm, a grain diameter distribution of 24% and an average aspect ratio of 11.0.

Characteristics of the thus prepared emulsions Em-1 through Em-10 are shown in Table 2.

TABLE 2

| Emulsion | Grain diameter distribution (%) | $I_1$ | $I_2/I_1$ | Compound (I) |
|---|---|---|---|---|
| Em-1 (Comp.) | 16 | 9.0 | 1.25 | — |
| Em-2 (Comp.) | 16 | 36.0 | 1.0 | — |
| Em-3 (Inv.) | 16 | 30.0 | 0.83 | — |
| Em-4 (Inv.) | 16 | 16.0 | 0.63 | — |
| Em-5 (Inv.) | 16 | 13.0 | 0.42 | — |
| Em-6 (Inv.) | 16 | 10.5 | 0.32 | — |
| Em-7 (Inv.) | 16 | 11.5 | 0.67 | — |
| Em-8 (Inv.) | 16 | 14.0 | 0.31 | 4 |
| Em-9 (Inv.) | 16 | 12.0 | 0.28 | 16 |
| Em-10 (Inv.) | 24 | 9.0 | 0.36 | — |

In the 10th layer of the following sample formula was used each of emulsions Em-1 to Em-10, which was denoted as "Silver iodobromide emulsion g". Emulsions Em-1 to Em-10 were each optimally spectrally and chemically sensitized as described below.

On a triacetyl cellulose film support were formed the following layers containing composition as shown below to prepare a multi-layered color photographic material Samples 101 to 110. The addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer: Anti-Halation Layer | |
| Black colloidal silver | 0.16 |
| UV absorbent (UV - 1) | 0.3 |
| Colored magenta coupler (CM-1) | 0.123 |
| Colored cyan coupler (CC-1) | 0.044 |
| High boiling solvent (OIL - 1) | 0.167 |
| Gelatin | 1.33 |
| 2nd Layer: Intermediate Layer | |
| Anti-staining agent (AS-1) | 0.16 |
| High boiling solvent (OIL - 1) | 0.20 |
| Gelatin | 0.69 |
| 3rd Layer: Low-speed Red-Sensitive Layer | |
| Silver iodobromide emulsion a | 0.12 |
| Silver iodobromide emulsion b | 0.29 |
| Sensitizing dye (SD - 1) | $2.37\times10^{-5}$ |
| Sensitizing dye (SD - 2) | $1.2\times10^{-4}$ |
| Sensitizing dye (SD - 3) | $2.4\times10^{-4}$ |
| Sensitizing dye (SD - 4) | $2.4\times10^{-6}$ |
| Cyan coupler (C - 1) | 0.32 |
| Colored cyan coupler (CC - 1) | 0.038 |
| High boiling solvent (OIL-2) | 0.28 |

-continued

| | |
|---|---|
| Anti-staining agent (AS-2) | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| Sensitizing dye (SD-1) | $4.5 \times 10^{-5}$ |
| Sensitizing dye (SD-2) | $2.3 \times 10^{-4}$ |
| Sensitizing dye (SD-3) | $4.5 \times 10^{-4}$ |
| Cyan coupler (C-2) | 0.52 |
| Colored cyan coupler (CC-1) | 0.06 |
| DIR compound (DI-1) | 0.047 |
| High boiling solvent (OIL-2) | 0.46 |
| Anti-staining agent (AS-2) | 0.004 |
| Gelatin | 1.30 |
| 5th Layer: High-speed Red-Sensitive Layer | |
| Silver iodobromide emulsion c | 0.13 |
| Silver iodobromide emulsion d | 1.18 |
| Sensitizing dye (SD - 1) | $3.0 \times 10^{-5}$ |
| Sensitizing dye (SD - 2) | $1.5 \times 10^{-4}$ |
| Sensitizing dye (SD - 3) | $3.0 \times 10^{-4}$ |
| Cyan coupler (C - 2) | 0.047 |
| Cyan coupler (C-3) | 0.09 |
| Colored cyan coupler (CC - 1) | 0.036 |
| DIR compound (DI-1) | 0.024 |
| High boiling solvent (OIL-2) | 0.27 |
| Anti-staining agent (AS-2) | 0.006 |
| Gelatin | 1.28 |
| 6th Layer: Intermediate Layer | |
| High boiling solvent (OIL-1) | 0.29 |
| Anti-staining agent (AS-1) | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| Sensitizing dye (SD-4) | $3.6 \times 10^{-4}$ |
| Sensitizing dye (SD-5) | $3.6 \times 10^{-4}$ |
| Magenta coupler (M - 1) | 0.18 |
| Colored magenta coupler (CM - 1) | 0.033 |
| High boiling solvent (IL-1) | 0.22 |
| Anti-staining agent (AS-2) | 0.002 |
| Anti-staining agent (AS-3) | 0.05 |
| Gelatin | 0.61 |
| 8th layer: Interlayer | |
| High boiling solvent (OIL-1) | 0.26 |
| Anti-staining agent (AS-1) | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| Sensitizing dye (SD-6) | $3.7 \times 10^{-4}$ |
| Sensitizing dye (SD-7) | $7.4 \times 10^{-5}$ |
| Sensitizing dye (SD-8) | $5.0 \times 10^{-5}$ |
| Magenta coupler (M - 1) | 0.17 |
| Magenta coupler (M-2) | 0.33 |
| Colored cyan couple (CM - 1) | 0.024 |
| Colored magenta coupler (CM-2) | 0.029 |
| DIR compound (DI-2) | 0.024 |
| DIR compound (DI-3) | 0.005 |
| High boiling solvent (OIL-1) | 0.73 |
| Anti-staining agent (AS-2) | 0.003 |
| Anti-staining agent (AS-3) | 0.035 |
| Gelatin | 1.80 |
| 10th Layer: High-speed Green-Sensitive Layer | |
| Silver iodobromide emulsion g | 1.19 |
| Sensitizing dye (SD-6) | $4.0 \times 10^{-4}$ |
| Sensitizing dye (SD-7) | $8.0 \times 10^{-5}$ |
| Sensitizing dye (SD-8) | $5.0 \times 10^{-5}$ |
| Magenta coupler (M - 1) | 0.065 |
| Colored magenta coupler (CM-1) | 0.022 |
| Colored magenta coupler (CM-2) | 0.026 |
| DIR compound (DI-2) | 0.003 |
| DIR compound (DI-3) | 0.003 |

-continued

| | |
|---|---|
| High boiling solvent (OIL-1) | 0.19 |
| High boiling solvent (OIL-2) | 0.43 |
| Anti-staining agent (AS-2) | 0.014 |
| Anti-staining agent (AS-3) | 0.017 |
| Gelatin | 1.23 |
| 11th Layer: Yellow Filter Layer | |
| Yellow colloidal silver | 0.05 |
| High boiling solvent (OIL-1) | 0.18 |
| Anti-staining agent (AS-1) | 0.16 |
| Gelatin | 1.00 |
| 12th Layer: Low-speed Blue-sensitive Layer | |
| Silver iodobromide emulsion a | 0.08 |
| Silver iodobromide emulsion b | 0.22 |
| Sensitizing dye (SD-9) | $6.5 \times 10^{-4}$ |
| Sensitizing dye (SD-10) | $2.5 \times 10^{-4}$ |
| Yellow coupler (Y-1) | 0.77 |
| DIR compound (DI-4) | 0.017 |
| High boiling solvent (OIL-1) | 0.31 |
| Anti-staining agent (AS-2) | 0.002 |
| Gelatin | 1.29 |
| 13th Layer: High-sped Blue-sensitive Layer | |
| Silver iodobromide emulsion h | 0.41 |
| Silver iodobromide emulsion i | 0.61 |
| Sensitizing dye (SD-9) | $4.4 \times 10^{-4}$ |
| Sensitizing dye (SD-10) | $1.5 \times 10^{-4}$ |
| Yellow coupler (Y-1) | 0.23 |
| High boiling solvent (OIL-1) | 0.10 |
| Anti-staining agent (AS-2) | 0.004 |
| Gelatin | 1.20 |
| 14th Layer: First Protective Layer | |
| Silver iodobromide emulsion j | 0.30 |
| UV absorbent (UV-1) | 0.055 |
| UV absorbent (UV-2) | 0.110 |
| High boiling solvent (OIL-2) | 0.30 |
| Gelatin | 1.32 |
| 15th Layer: Second protective Layer | |
| Polymer PM-1 | 0.15 |
| Polymer PM-2 | 0.04 |
| Lubricant (WAX-1) | 0.02 |
| Dye (D-1) | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| h | 0.65 | 8.0 | 1.4 |
| i | 1.00 | 8.0 | 2.0 |
| j | 0.05 | 2.0 | 1.0 |

Of the emulsions described above, for example, emulsions d and f were prepared according to the following procedure described below. Emulsion j was prepared by reference to JP-A 1-183417, 1-183644, 1-183645 and 2-166442.

Preparation of Seed Emulsion-1

To Solution A1 maintained at 35° C. and stirred with a mixing stirrer described in JP-B 58-58288 and 58-58289 were added an aqueous silver nitrate solution (1.161 mol)

and an aqueous potassium bromide and potassium iodide mixture solution (containing 2 mol % potassium iodide) by the double jet method in 2 min., while keeping the silver potential at 0 mV (measured with a silver electrode and a saturated silver—silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 μm and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A | |
|---|---|
| Ossein gelatin | 24.2 g |
| Potassium bromide | 10.8 g |
| $HO(CH_2CH_2O)m(CH(CH_3)CH_2O)_{19.8}(CH_2CH_2O)NH$ (m + n = 9.77) 10 wt. % methanol solution | 6.78 ml |
| Nitric acid (1.2N) | 114 ml |
| Distilled water to make | 9657 ml |

Preparation of Fine Silver Iodide Grain Emulsion SMC-1

To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 gm, and was denoted as SMC-1.

Preparation of Silver Iodobromide Emulsion d 700 ml of an aqueous 4.5 wt. % inert gelatin solution containing 0.178 mol equivalent of Seed Emulsion-1 and 0.5 ml of a 10% surfactant (SU-1) ethanol solution was maintained at 75° C. and after adjusting the pAg and pH to 8.3 and 5.0, respectively, a silver halide emulsion was prepared while vigorously stirring, according to the following procedure.

1) An aqueous silver nitrate solution of 3.093 mol, SMC-1 of 0.287 mol and an aqueous potassium bromide solution were added by the double jet method while keeping the pAg and pH were maintained at 8.4 and 5.0, respectively.

2) Subsequently, the temperature was lowered to 60 ° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.75 μm, average aspect ratio of 5.0 and exhibiting the iodide content from the grain interior of 2/8.5/X/3 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 6.7 mol %.

Preparation of Silver Iodobromide Emulsion f

Silver iodobromide emulsion f was prepared in the same manner as emulsion d, except that in the step 1), the pAg, the amount of silver nitrate to be added and the SMC-1 amount were varied to 8.8, 2.077 mol and 0.218 mol. respectively; and in the step 3), the amounts of silver nitrate and SMC-1 were varied to 0.91 mol and 0.079 mol, respectively. The resulting emulsion was comprised of tabular grains having an average size (an edge length of a cube with an equivalent volume) of 0.65 μm, average aspect ratio of 6.5 and exhibiting the iodide content from the grain interior of 2/9.5/X/8 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 11.9 mol %.

The thus prepared emulsions d and f were added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point. Silver iodobromide emulsions a, b, c, g, h, and i were each spectrally and chemically sensitized in a manner similar to silver iodobromide emulsions d and f.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

SU-1: $C_8F_{17}SO_2N(C_3H_7)CH_2COOK$

SU-2: $C_8F_{17}SO_2NH(CH_2)3N^+(CH_3)_3Br^-$

Su-3: Sodium di-(2-ethylhexyl)sulfosuccinate

SU-4: Tri-i-propylnaphthalenesulfonic acid sodium salt

ST-1: 4-hydroxy-6-methyl-1,3,3a, 7-tetraazaindene

ST-2: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $[CH_2{=}CHSO_2CH_2)_3CCH_2SO_2CH_2CH_2]_2NCH_2CH_2SO_3K$

H-2: 2,4-Dichloro-6-hydroxy-s-triazine sodium salt

OIL-1: Tricresyl phosphate

OIL-2: Di (2-ethylhexyl)phthalate

AS-1: 2,5-Bis(1,1-dimethyl-4-hexyloxycarbonylbutyl) hydroquinone

As-2: Dodecyl gallate

AS-3: 1,4-Bis(2-tetradecyloxycarbonylethyl)piperazine

C-1
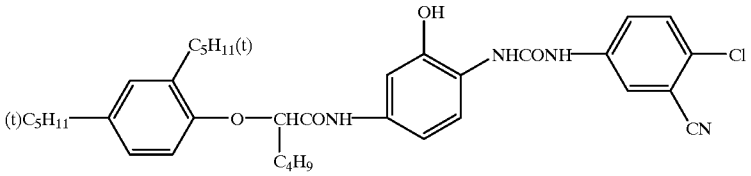
C-2
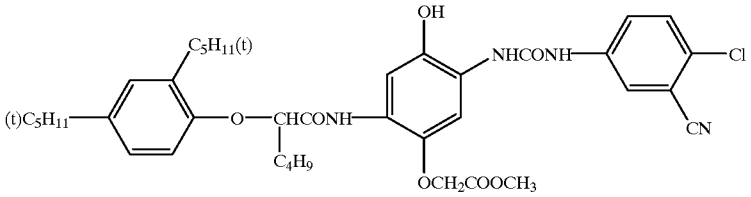
C-3
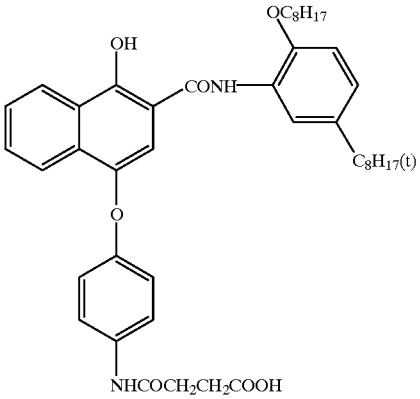
M-1
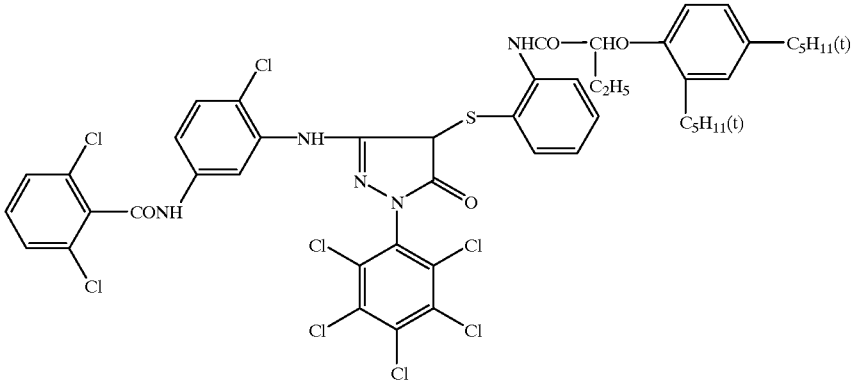
M-2
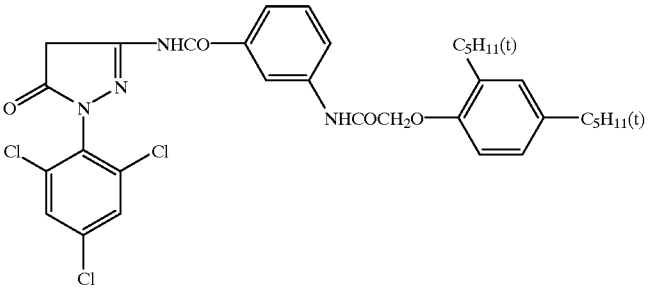

-continued
Y-1
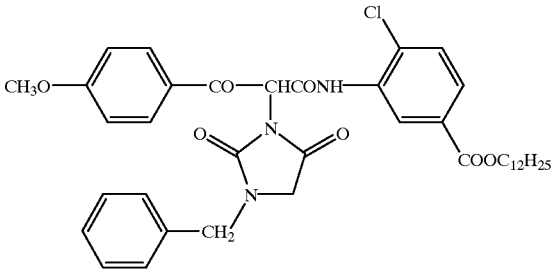
CC-1
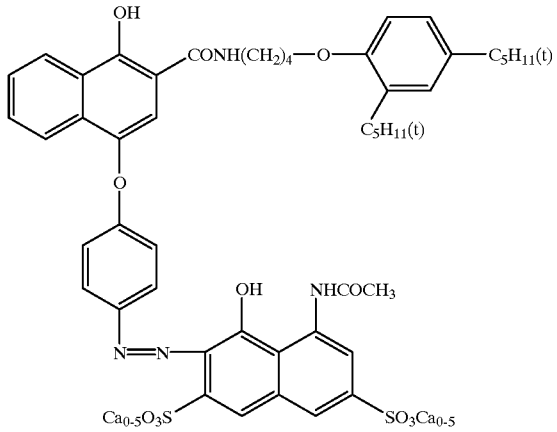
CM-1
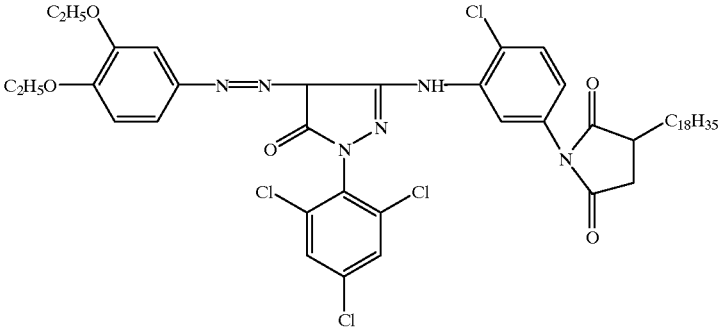
CM-2
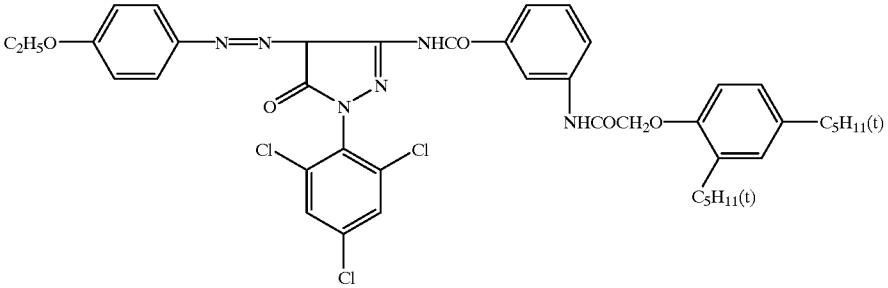

-continued
DI-1
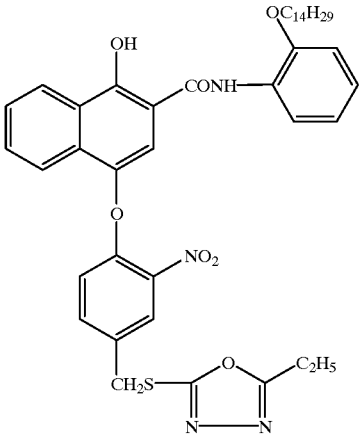
DI-2
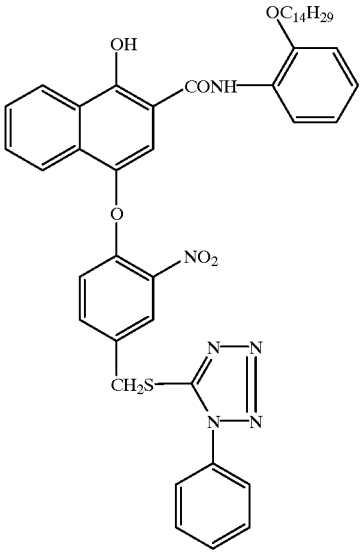
DI-3
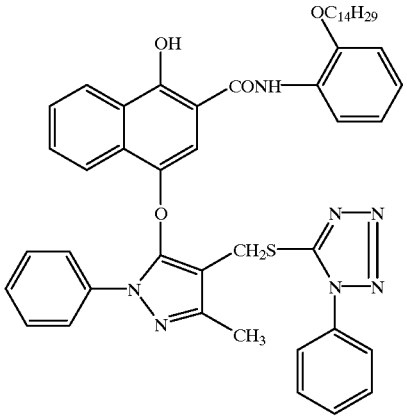

-continued
DI-4
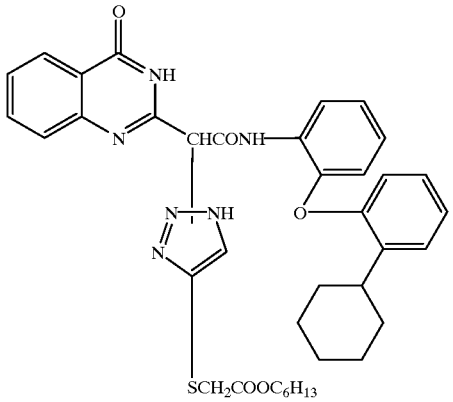
SD-1
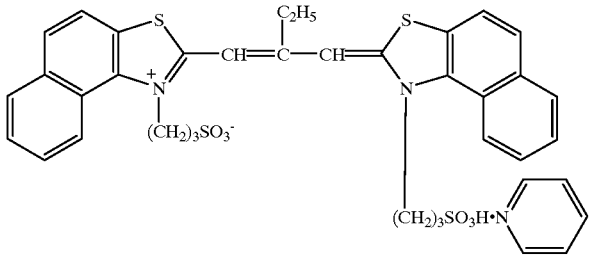
SD-2
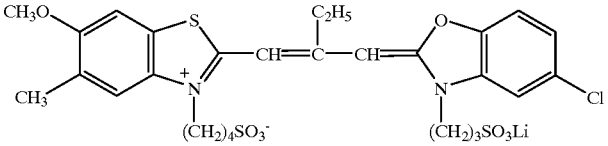
SD-3
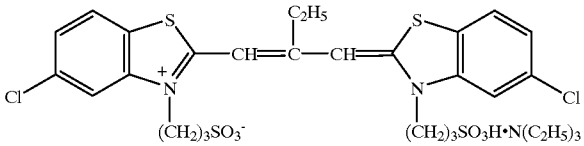
SD-4
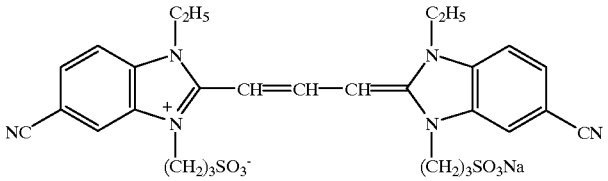
SD-5
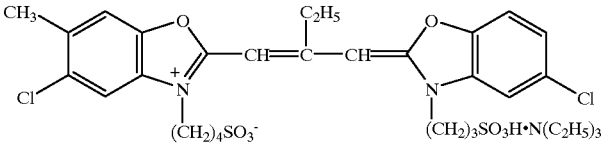
SD-6
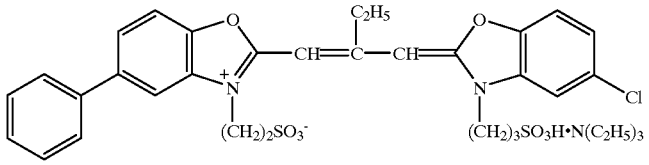

-continued
SD-7
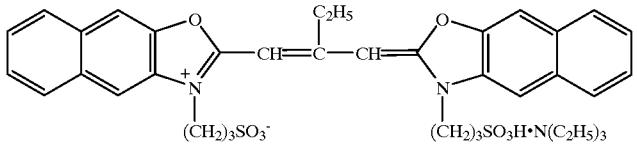
SD-8
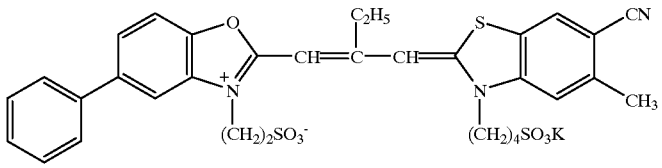
SD-9
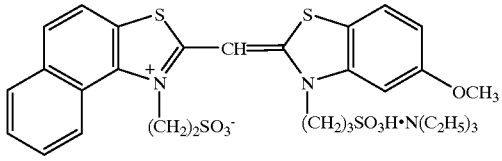
SD-10
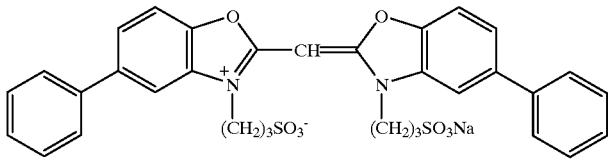
WAX-1
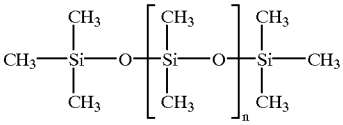
Mw=3,000
D-1
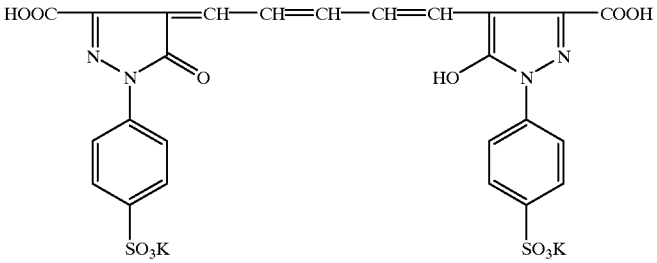
PM-1
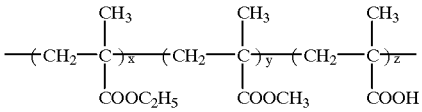
*x*:*y*:*z* = 3:3:4
PM-2
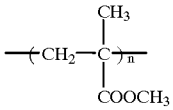
*n*: Polmerization degree -continued

UV-1

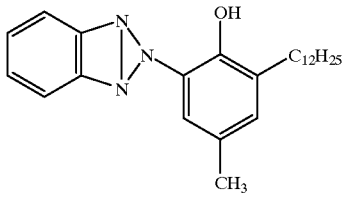

UV-2

$(C_6H_{13})_2N—CH═CH—CH═C(CN)_2$

V-1

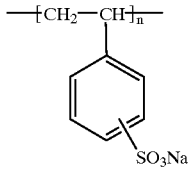

*n*: Polymerization degree

Ase-1 (Mixture)

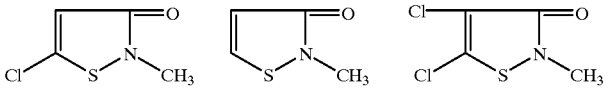

(A) (B) (C)

A:B:C = 50:46:4 (molar ratio)

Samples 101 to 110 were each processed according to the following procedure.

Processing:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*Amounts per $m^2$ of photographic material

A color developer, bleach, fixer and stabilizer each were prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and its replenisher were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Evaluation of Sensitivity

Samples 101 to 110 were exposed through an optical wedge, to white light at 3.2 CMS for 1/200 sec. and processed. From an obtained characteristic curve of each sample was determined a green sensitivity. Thus, the sensitivity was shown as a relative value of reciprocal of exposure necessary for giving a density of fog density plus 0.10 of a magenta density, based on the sensitivity of Sample 101 being 100. Results thereof are shown on Table 3.

TABLE 3

| Sample No. | Emulsion | Sensitivity |
|---|---|---|
| 101 (Comp.) | Em-1 | 100 |
| 102 (Comp.) | Em-2 | 80 |
| 103 (Inv.) | Em-3 | 110 |
| 104 (Inv.) | Em-4 | 120 |
| 105 (Inv.) | Em-5 | 128 |
| 106 (Inv.) | Em-6 | 132 |
| 107 (Inv.) | Em-7 | 118 |
| 108 (Inv.) | Em-8 | 134 |
| 109 (Inv.) | Em-9 | 133 |
| 110 (Inv.) | Em-10 | 122 |

As is apparent from Table 3, Samples 103 to 110 in which inventive emulsions Em-3 to Em-10 were employed, exhibited superior sensitivity to Samples 101 and 102 by the use of comparative emulsions Em-1 and Em-2.

Example 2

Preparation of Comparative Emulsion Em-1

Using the seed emulsion T-1 of Example 1 and the following solutions, comparative emulsion Em-11 was prepared.

| | |
|---|---|
| H-3 Solution | |
| Ossein gelatin | 223.6 g |
| 10% Surfactant (SU-1) methanol solution | 3.6 ml |
| Seed emulsion T-1 | 0.774 mol equivalent |
| Water to make | 5904 ml |
| I-3 Solution | |
| 3.5N silver nitrate aqueous solution | 6490 ml |
| J-2 Solution | |
| 3.5N potassium bromide solution | 7500 ml |
| K-2 Solution | |
| Fine grain emulsion comprised of 3.0 wt. % gelatin and fine silver iodide grains (average diameter of 0.05 μm) used in Em-2 of Example 1 | Necessary amount |

-continued

| | |
|---|---|
| L-3 Solution | |
| 1.75N Potassium bromide aqueous solution | Necessary amount |
| M-3 Solution | |
| 56 wt. % acetic acid aqueous solution | Necessary amount |
| N-3 Solution | |
| 3.5N Potassium bromide aqueous solution | 500 ml |

To a reaction vessel was added solution H-3 and solutions I-3 and J-3 were added with vigorously stirring by the double jet addition, as shown in Table 4, so that the seed grains were allowed to grow to obtain a core/shell type silver halide grain emulsion. Herein, taking into account a critical growth rate, solutions I-3, J-3 and K-2 were added at an accelerated flow rate so that production of fine grains other than growing seed grains and widening of grain diameter distribution due to Ostwald ripening between growing grains did not occur. Grain growth was performed in a manner such that the initial addition was conducted, while the temperature and pAg of a solution within a reaction vessel were controlled at 75° C. and 8.8, respectively, thereafter, the temperature was lowered to 60° C. in 15 min., solution N-3 was added for 4 min., solution K-2 was added in an amount of 2 mol % of total silver halide and then the secondary addition was conducted while controlled at a temperature of 60° C., a pAg of 9.8 and a pH of 5.8. The pAg and pH were each controlled by adding solutions L-3 and M-3. After completing grain formation, the emulsion was desalted according to the procedure described in JP-A 5-72658 and redispersed by adding gelatin thereto to obtain an emulsion with a pAg of 8.06 and a pH of 5.8. From electron microscopic observation of silver halide emulsion grains obtained, it was proved that the resulting emulsion was comprised of monodispersed, hexagonal tabular silver halide grains having an average diameter of 1.40 μm, a grain diameter distribution of 16% and an average aspect ratio of 9.0. Further, the tabular silver halide grains were each shown to have dislocation lines peripheral portions of the grain.

TABLE 4

| Added solution | Add.time (min) | Added silver amount (%) | Iodide content* (mol %) | Remark |
|---|---|---|---|---|
| I-3 | 0.00 | 0.0 | 8.5 | 1st |
| J-3 | 23.13 | 5.0 | 8.5 | Addition |
| K-2 | 41.45 | 10.0 | 8.5 | |
| | 70.27 | 20.0 | 8.5 | |
| | 110.56 | 40.0 | 8.5 | |
| | 142.89 | 66.0 | 8.5 | |
| I-3 | 161.89 | 68.0 | 7.0 | 2nd |
| J-3 | 182.73 | 80.0 | 7.0 | Addition |
| K-2 | 191.34 | 90.0 | 7.0 | |
| | 199.64 | 100.0 | 7.0 | |

*An iodide content of an added halide solution

Preparation of Comparative Emulsion Em-12

Comparative emulsion Em-12 was prepared in the same manner as the emulsion Em-11, except that prior to desalting, solution K-2 was added in an amount corresponding to 1.5 mol % of the total silver halide amount.

Preparation of Inventive Emulsion Em-13

Emulsion Em-13 of the present invention was prepared in the same manner as emulsion Em-11, except that in place of desalting according to JP-A 5-72658, the emulsion was subjected to the ultrafiltration A described in Example 1, the temperature was raised to 60° C., the pBr was adjusted to 1.7 with a 2N potassium bromide aqueous solution, solution Q-3 described below was added in an amount corresponding to 2 mol % of total silver halide, ripened for 30 min., subjected to the ultrafiltration A, thereafter, the temperature was again raised to 60° C., the pBr was adjusted to 1.1 with a 2N potassium bromide aqueous solution, then, solution R-2 used in Em-5 of Example 1 was added in an amount of 3 mol % of total silver halide and the emulsion was further ripened for 15 min. and subjected to the ultrafiltration A.

Solution Q-3

Fine grain emulsion comprised of 3.0 wt. % gelatin and fine silver iodobromide grains (average diameter of 0.05 μm and iodide content of 8 mol %)

Preparation

To 5000 ml of a 6.0 wt. % gelatin aqueous solution containing 0.06 mol potassium bromide was added 2000 ml of an aqueous solution containing 7.06 mol silver nitrate and 2000 ml of an aqueous solution containing 6.50 mol potassium bromide and 0.56 mol potassium iodide at a constant flow rate for 10 min. During addition, the pH and temperature were maintained at 3.0 with nitric acid and at 30° C. After completing addition, the resulting emulsion was adjusted to a pH of 6.0 with a sodium carbonate aqueous solution and subjected to the ultrafiltration A.

Preparation of Inventive Emulsion Em-14

Emulsion Em-14 of the present invention was prepared in the same manner as emulsion Em-11, except that in place of desalting according to JP-A 5-72658, the emulsion was subjected to the ultrafiltration A described in Example 1, the temperature was raised to 60° C., the pBr was adjusted to 1.7 with a 2N potassium bromide aqueous solution, solution Q-3 described below was added in an amount corresponding to 1 mol % of the total silver amount, ripened for 30 min., subjected to the ultrafiltration A, thereafter, the temperature was again raised to 60° C., the pBr was adjusted to 1.0 with a 2N potassium bromide aqueous solution, then, solution R-2 used in Em-5 of Example 1 was added in an amount of 2 mol % of total silver halide and the emulsion was further ripened for 15 min. and subjected to the ultrafiltration A.

Preparation of Inventive Emulsion Em-15

Emulsion Em-15 of the present invention was prepared in the same manner as emulsion Em-11, except that in place of desalting according to JP-A 5-72658, the emulsion was subjected to the ultrafiltration A described above, the temperature was raised to 60° C., the pBr was adjusted to 1.1 with a 2N potassium bromide aqueous solution, solution R-2 described above was added in an amount corresponding to 3 mol % of total silver halide, ripened for 20 min., subjected to the ultrafiltration A, thereafter, the temperature was again raised to 60° C., solution S-2 used in Em-7 of Example 1 was added in an amount of 30 ml per mol of silver halide, after 10 min., exemplified Compound 4) relating to the invention was added in an amount of $1.5\times10^{-4}$ mol % of total silver halide and then subjected to the ultrafiltration A.

Characteristics of the thus prepared emulsions Em-11 to Em-15 in Table 5.

TABLE 5

| Emulsion | Grain diameter distribution (%) | $I_1$ | $I_2/I_1$ | Compound (I) |
|---|---|---|---|---|
| Em-11 (Comp.) | 16 | 9.0 | 1.25 | — |
| Em-12 (Comp.) | 16 | 36.0 | 1.0 | — |
| Em-13 (Inv.) | 16 | 30.0 | 0.83 | — |

TABLE 5-continued

| Emulsion | Grain diameter distribution (%) | $I_1$ | $I_2/I_1$ | Compound (I) |
|---|---|---|---|---|
| Em-14 (Inv.) | 16 | 16.0 | 0.63 | — |
| Em-15 (Inv.) | 16 | 14.0 | 0.31 | 4 |

Using emulsions Em-11 to Em-15, multi-layered color photographic material Samples 111 to 115 were prepared and evaluated in a manner similar to Example 1. Results thereof are shown in Table 6.

TABLE 6

| Sample No. | Emulsion | Sensitivity |
|---|---|---|
| 111 (Comp.) | Em-11 | 100 |
| 112 (Comp.) | Em-12 | 80 |
| 113 (Inv.) | Em-13 | 110 |
| 114 (Inv.) | Em-14 | 120 |
| 115 (Inv.) | Em-15 | 128 |

As is apparent from Table 6, Samples 113 to 115 in which emulsions Em-13 to Em-1i were employed, exhibited superior sensitivity to Samples 111 and 112 by the use of comparative emulsions Em-1 and Em-2.

What is claimed is:

1. A silver halide emulsion comprising a dispersing medium and silver halide grains, wherein at least 50% by number of the silver halide grains is accounted for by tabular silver halide core/shell type grains containing silver iodide, said tabular grains each meeting the following requirement:

$$I_1>I_2$$

wherein $I_1$ is a silver iodide content of an outermost shell layer in the major face region and $I_2$ is a silver iodide content of an outermost layer in the side-face region.

2. The silver halide emulsion of claim 1, wherein said tabular grains each meet the following requirements:

$$I_2/I_1<0.77$$

and $$I_1<30 \text{ mol } \%.$$

3. The silver halide emulsion of claim 1, wherein said tabular grains each meet the following requirements:

$$I_2/I_1<0.4.$$

4. The silver halide emulsion of claim 1, wherein said tabular grains each meet the following requirement:

$$I_3>I_2$$

wherein $I_3$ is a silver iodide content of an adjacent layer to the outermost layer in the side-face region.

5. The silver halide emulsion of claim 1, wherein said tabular grains have an aspect ratio of 1.3 or more, and accounting for at least 50% of total grain projected area.

6. The silver halide emulsion of claim 1, wherein said silver halide emulsion is monodispersed.

7. The silver halide emulsion of claim 1, wherein said emulsion is prepared by a process comprising the steps of:

(i) mixing a silver salt and a halide salt in the presence of the dispersing medium to form silver halide grains, (ii) subjecting the formed silver halide grains to desalting, (iii) subjecting the silver halide grains to spectral sensitization and (iv) subjecting the silver halide grains to chemical sensitization, wherein a compound represented by the following formula (I) is added at any one of the steps (i) to (iv):

$$A\text{-}\{\text{-}(L)m\text{-}(Z)n\}r \qquad \text{formula (I)}$$

wherein A represents an adsorption group onto silver halide, L represents a divalent or trivalent linkage group, Z represents a substituent capable of releasing a halide ion, m is 0 or 1, n is 1 or 2, and r is 1, 2 or 3.

8. A silver halide light sensitive photographic material comprising a support having thereon a silver halide emulsion layer containing silver halide grains, wherein at least 50% by number of the silver halide grains is accounted for by tabular silver halide grains containing silver iodide, said tabular grains each having two parallel major faces and side-faces, and meeting the following requirement:

$$I_1 > I_2$$

wherein $I_1$ is an average silver iodide content of an outermost layer in the major face region and $I_2$ is an average silver iodide content of an outermost layer in the side-face region.

9. The silver halide photographic material of claim 7, wherein said tabular grains each meet the following requirements:

$$I_2/I_1 < 0.77$$

and $$I_1 < 30 \text{ mol } \%.$$

10. The silver halide photographic material of claim 8, wherein said tabular grains each meet the following requirements:

$$I_2/I_1 < 0.4.$$

* * * * *